US006712447B2

(12) United States Patent
Saito

(10) Patent No.: US 6,712,447 B2
(45) Date of Patent: Mar. 30, 2004

(54) INK JET RECORDING APPARATUS

(75) Inventor: Hiroyuki Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/234,157

(22) Filed: Sep. 5, 2002

(65) Prior Publication Data

US 2003/0063149 A1 Apr. 3, 2003

(30) Foreign Application Priority Data

Sep. 6, 2001 (JP) ..... 2001/270799

(51) Int. Cl.[7] ..... B41J 2/165
(52) U.S. Cl. ..... 347/29; 347/30
(58) Field of Search ..... 347/29, 14, 19, 347/23, 24, 30, 32, 33

(56) References Cited

U.S. PATENT DOCUMENTS

| | | | |
|---|---|---|---|
| 5,245,362 A | 9/1993 | Iwata et al. | 347/23 |
| 5,426,456 A | 6/1995 | Kuelzer et al. | 347/30 |
| 6,109,725 A | 8/2000 | Saikawa et al. | 347/33 |

FOREIGN PATENT DOCUMENTS

| | | |
|---|---|---|
| EP | 0 317 267 | 5/1989 |
| EP | 0 664 216 | 7/1995 |
| EP | 0 678 389 | 10/1995 |
| EP | 0 933 215 | 8/1999 |
| EP | 1 106 359 | 6/2001 |

OTHER PUBLICATIONS

U.S. application No. 09/679,605, filed Oct. 5, 2000, 6,565,188.
U.S. application No. 09/902,758, filed Jul. 12, 2001, pending.
U.S. application No. 09/235,759, filed Sep. 6, 2002, pending.
European Search Report in EP 02 01 9912, dated Nov. 20, 2002.

*Primary Examiner*—Shih-Wen Hsieh
(74) *Attorney, Agent, or Firm*—Fitzpatrick, Cella, Harper & Scinto

(57) ABSTRACT

The present invention provides an ink jet recording apparatus for effecting recording by using recording device for discharging plural different inks, comprising a cap for covering a plurality of discharge ports for discharging the different inks, and a pump connected to a suction port of the cap and adapted to apply negative pressure to interior of the cap, and wherein the discharge ports and the suction port are arranged so that flow paths of the inks flowing from the respective discharge ports to the suction port when the inks are sucked from the discharge ports by driving the pump do not pass by the discharge ports for the different inks.

8 Claims, 23 Drawing Sheets

INK JET RECORDING APPARATUS

BACKGROUND OF THE INVENTION

1. Field of the Invention

The Present invention relates to an ink jet recording apparatus for effecting recording by using recording means for discharging plural different color inks.

2. Related Background Art

A recording apparatus having a function such as a printer function, a copier function, a facsimile function and the like, a composite electronic equipment or work station including a computer, a word processor and the like, and a recording apparatus used as an output device of an industrial recording apparatus compositely combined with various types of processing equipments are designed so that an image (including a character and/or a symbol) is recorded (or printed) on a recording medium (recording material) such as a paper, cloth, a plastic sheet, an OHP sheet or the like on the basis of recording information. Such recording apparatuses can be grouped into an ink jet type, a wire dot type, a thermal type, a laser beam type and the like in dependence upon a recording system.

In a recording apparatus of serial type in which the recording is effected while performing main scanning along a direction transverse to a conveying direction (paper feeding direction or sub-scanning direction) of a recording medium, an image is recorded by a recording head (as recording means) mounted on a carriage shifted (main-scanned) along the recording medium. In the apparatus, by repeating such an operation that a predetermined amount of sheet feeding (pitch conveyance as sub-scanning) is effected after one-line recording is finished, and then a next line image is recorded (main scanning) on the recording medium which is now stopped, the recording is performed with respect to the entire recording medium. On the other hand, in a recording apparatus of line type in which the recording is effected only by the sub-scanning in the conveying direction of the recording medium (recording material), the recording medium is set at a predetermined recording position, and, by repeating such an operation that a predetermined amount of sheet feeding (pitch feeding) is effected after one-line recording is performed collectively and then next one-line recording is performed collectively, the recording is performed with respect to the entire recording medium.

Among such recording apparatuses, a recording apparatus of ink jet type (ink jet recording apparatus) performs the recording by discharging ink from a recording head as recording means toward a recording medium. The ink jet recording apparatus has the following advantages. That is to say, the recording means can easily be made compact, a highly fine image can be recorded at a high speed, an image can be recorded on a plain paper without special treatment, and a running cost is low. Further, since the apparatus is of non-impact type, noise is small, and a color image can easily be recorded by using plural color inks. Further, according to an ink jet recording apparatus of line type using a recording head of line type in which a large number of discharge ports are disposed along a width-wise direction of the recording paper, the recording can be effected at a higher speed.

Particularly, in recording means (recording head) of ink jet type for discharging ink by utilizing thermal energy, since high density arrangement of liquid paths (discharge port arrangement or nozzle arrangement) can be realized by means of electrical/thermal converters, electrodes and liquid path walls and a top plate formed on a substrate by a semiconductor manufacturing process such as etching, deposition and/or spattering, further compactness can be achieved. Further, in the ink jet recording apparatus, there have been various requests for the material quality of the recording medium (recording material), and, in recent years, development for such request has been progressed, and, thus, cloth, leather, non-woven fabric, metal and the like has been used as the recording medium, as well as normal recording media such as paper (including a thin paper and a processed or converted paper) and a plastic thin board (OHP and others).

In the ink jet recording apparatus, the image is recorded on the recording medium by discharging the ink from a discharge port in response to an electrical signal. In some cases, due to penetration of air into the discharge port or increase in viscosity of the ink by drying, the ink droplet may not be discharged from the discharge port in response to the electrical signal. As one of methods for restoring a normal discharging condition from such ink non-discharging condition (including a poor discharging condition), there is a method (suction recovery means) in which ink not contributing to the image recording is sucked and discharged from the discharge port. In such suction recovery means, in many cases, as one of means (pressure generating devices) for generating ink sucking negative pressure, a tube pump in which a negative pressure is generated in a pump tube by rotating a pump roller while urging the pump roller against the pump tube, i.e., by squeezing the pump tube, has been used. As suction recovery means, for example, there is an arrangement in which a suction hole is formed in a cap capable of capping the recording head and the tube pump is connected to the suction hole.

In some cases, the cap and the tube pump are designed to be driven cooperatively in accordance with a rotational direction of a driving source (for example, a purge motor) of a recovery unit. That is to say, first of all, the cap is urged against an ink discharge port forming face (discharge port face) of the recording head by a normal rotation of the purge motor, thereby capping the recording head. Then, the tube pump is driven reversely by a reverse rotation of the purge motor. When driven reversely, in the tube pump, the pump roller is rotated while being urged against the pump tube to squeeze the pump tube, thereby generating the negative pressure. The negative pressure is introduced into the cap through the suction hole. In this case, since the recording head is capped by the cap, the viscosity increased ink and/or bubbles unsuitable for the recording are sucked from the discharge ports of the recording head by the negative pressure introduced into the cap, and the different color inks flow toward the single suction hole of the cap through a cap absorbing body provided upwardly, thereby discharging the inks forcibly. Thereafter, by rotating the purge motor in the normal direction, the cap is separated from the ink discharge port forming face of the recording head to thereby release the capping. In this way, the suction recovery operation is completed.

However, in the recovery unit used in the conventional ink discharge recovery device including the above-mentioned arrangement, there is the following technical problem to be solved. That is to say, due to recent colorization, high image quality and high resolution, since the number of ink discharge ports has been increased, the number of ink colors has been increased and a size of the discharged ink droplet has been decreased, the handling of the recording head becomes more delicate. Thus, there is caused such trouble that different color inks enter into different color discharge ports to cause mixing of color (color mixing) in recording, with the result that a correct color recorded image cannot be obtained. This trouble frequently occurs in the suction recording operation. To cope with this, although a technique in which respective color discharge ports (or nozzles) are sucked by respective suction caps or a technique in which respective color discharge ports are successively sucked by a single cap, can be considered, such techniques make the mechanism more complicated and more bulky, and increase the cost and increase the suction recovery time. Further, in the technique in which the suction is effected by using the single cap, there is an apparatus having the technique in which, from after the suction recovery to immediately before the recording (printing), by discharging and discarding the ink in the vicinity of the discharge ports of the recording head, the inks in the respective color discharge ports (respective color nozzles) are made pure and then the recording is started. Also in this apparatus, as the number of discharge ports (nozzles) is increased, an amount of ink to be discarded tends to increase, and, thus, there still remains a technical problem (to be solved) that consumption of ink is hastened.

SUMMARY OF THE INVENTION

An object of the present invention is to provide an ink jet recording apparatus which can prevent different ink from entering into different discharge port even when plural different inks are sucked by using a single cap and which can recover a normal image recording condition of recording means having no color mixing with a simple and cheap construction and with a short time pre-ejection operation having low consumption of ink, and can prevent ink contamination within the apparatus by reducing generation of ink mist caused by the pre-ejection.

Another object of the present invention is to provide an ink jet recording apparatus for effecting recording by using recording means for discharging plural different inks, which comprises a cap for covering a plurality of discharge ports for discharging the different inks and a pump connected to a suction hole of the cap and adapted to generate negative pressure within the cap, and in which the discharge ports and the suction hole are arranged so that an ink flow path from the discharge ports to the suction hole when the inks are sucked from the discharge ports by operating the pump are not passed through the different ink discharge ports.

DETAILED DESCRIPTION OF THE PREFERRED EMBODIMENTS

Figure 1:
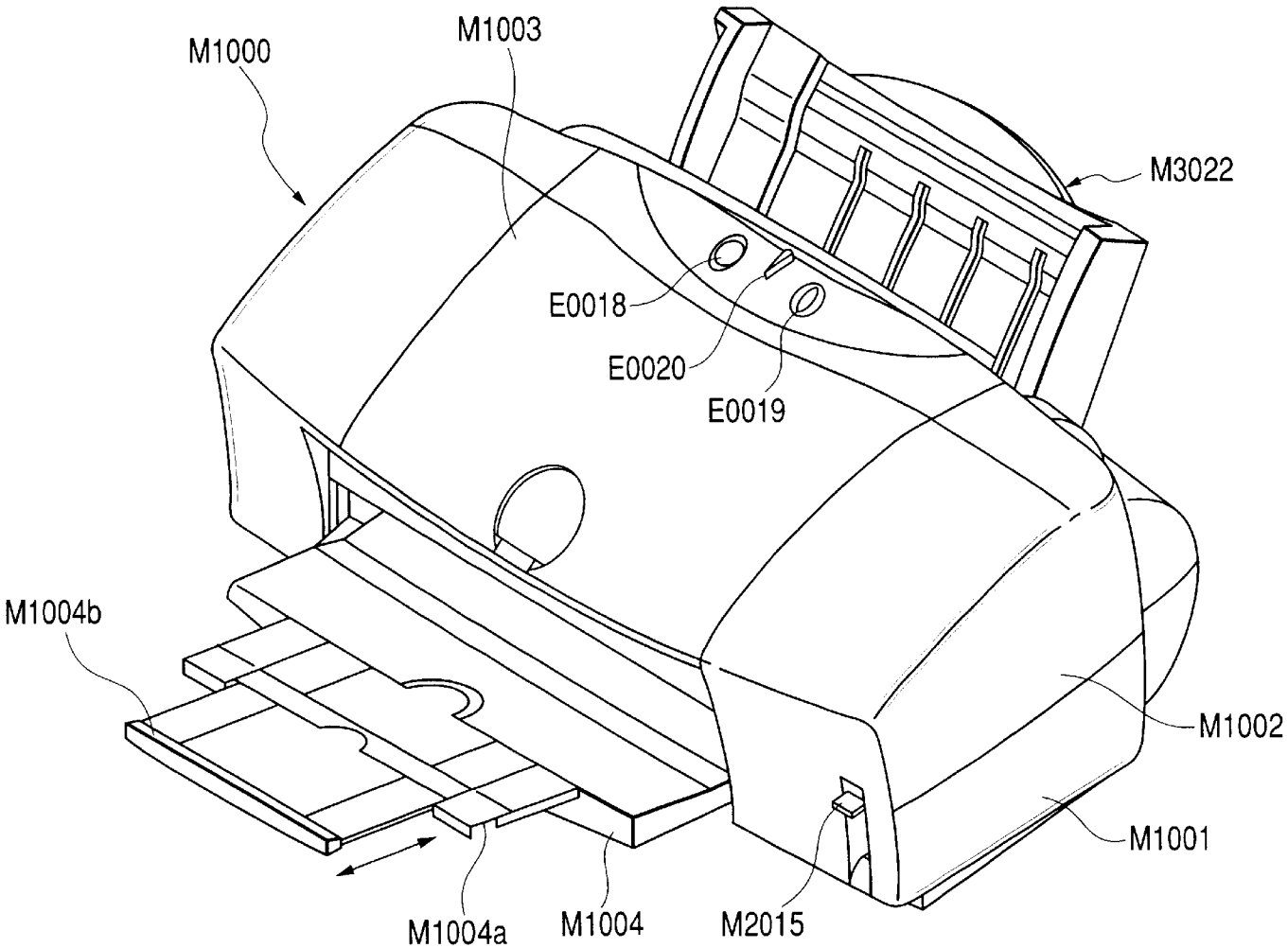
FIG. 1 is a schematic perspective view showing an appearance of an embodiment of an ink jet recording apparatus to which the present invention is applied.

The present invention will now be fully explained in connection with embodiments thereof with reference to the accompanying drawings. Incidentally, in the drawings, the same or corresponding elements are designated by the same reference numerals. Further, in the specification, a term "recording" (also referred to as "print(ing)") means that not only meaningful information such as a character and/or a figure is formed, but also an image, figure, pattern or the like (which may be or may not be visualized to be visually recognized by human being) is formed on a print medium or the medium is processed or converted, regardless of meaningful and meaningless. Here, the "print medium" includes not only a paper used in general printing apparatus but also any members capable of receiving ink, such as cloth, plastics, film, metallic plate, glass, ceramics, wood material, leather and the like. Further, a term "ink" (also referred to as "liquid") should be construed widely similar to the definition of the above-mentioned "print(ing)" and means any liquid applied to formation of the image, figure, pattern by being attached to the print medium or the like or applied to processing or conversion of the print medium or treatment of ink (for example, solidification or insolubility of coloring material ink applied to the print medium).

Figure 2:
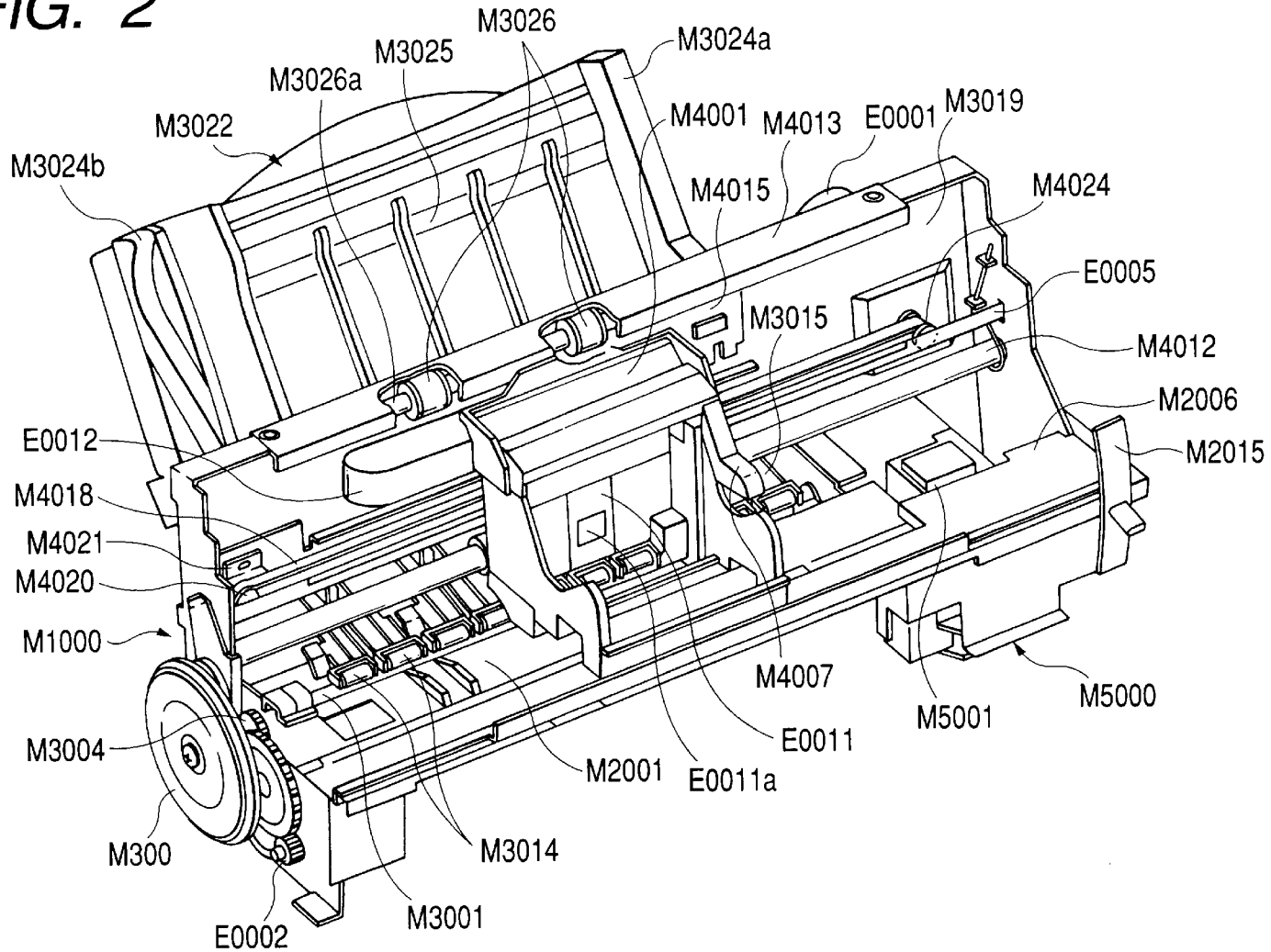
FIG. 2 is a schematic perspective view showing an internal structure of the ink jet recording apparatus according to the embodiment, with an outer frame member, recording means and ink tanks removed.
Figure 3:
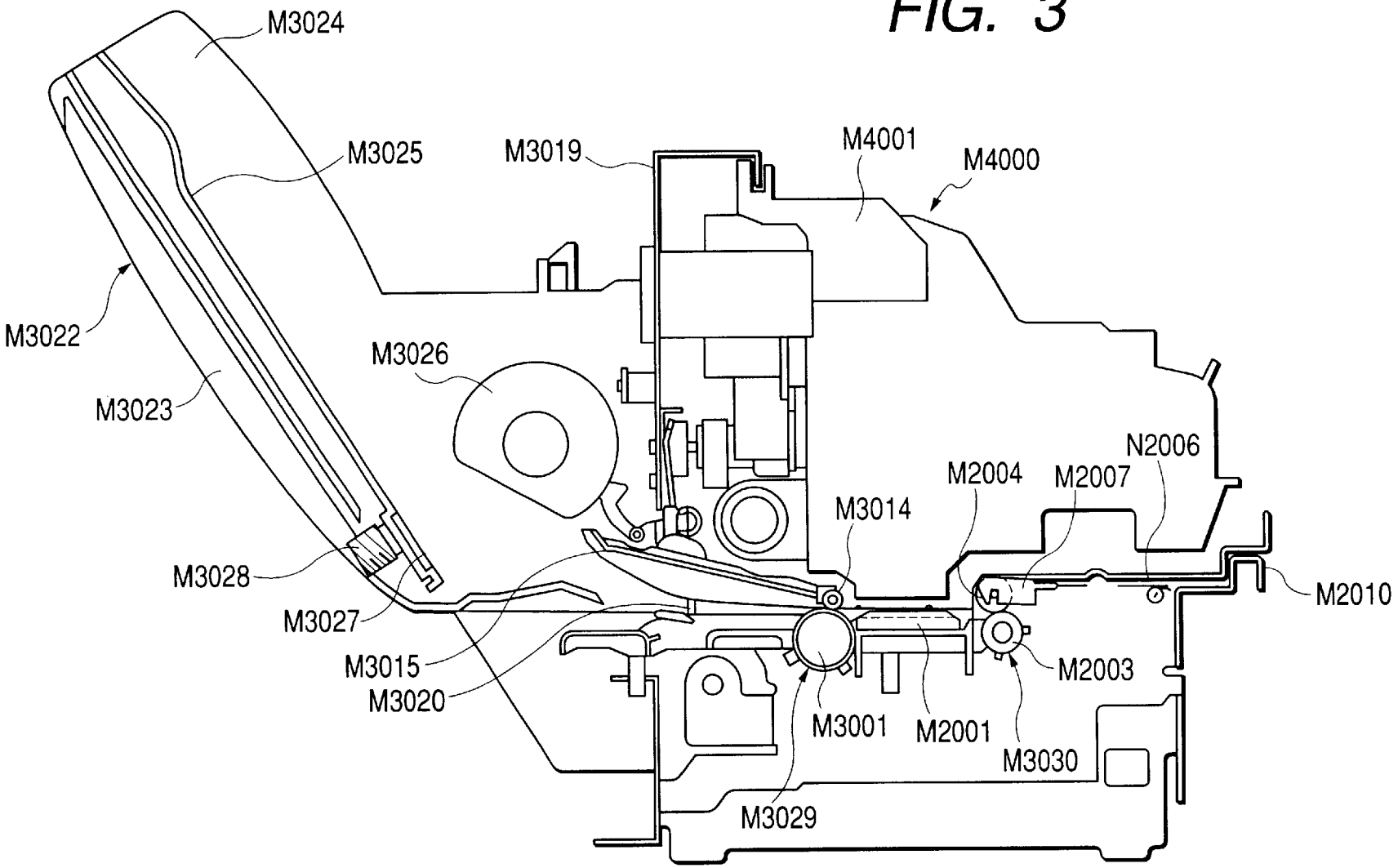
FIG. 3 is a schematic longitudinal sectional view showing main parts of the ink jet recording apparatus of FIG. 2.

In embodiments which will be described later, a printer will be described as an example of a recording apparatus using an ink jet recording system. Now, a fundamental construction of the printer will be explained with reference to FIGS. 1 to 12. FIG. 1 is a schematic perspective view showing an appearance of an embodiment of an ink jet recording apparatus to which the present invention is applied, FIG. 2 is a schematic perspective view showing an internal structure of the ink jet recording apparatus according to the embodiment, with an outer frame member, recording means and ink tanks removed, and FIG. 3 is a schematic longitudinal sectional view showing main parts of the ink jet recording apparatus of FIG. 2.

First of all, a main body of the ink jet recording apparatus will be explained with reference to FIGS. 1 to 3. In FIG. 1, a main body M1000 of the ink jet recording apparatus to which the present invention is applied is constituted by an outer frame members such as a lower case M1001, an upper case M1002, an access cover M1003 and a paper discharge tray M1004, and a chassis M3019 (refer to FIG. 2) housed within the outer frame member. The chassis M3019 is constituted by a plurality of plate-shaped metallic members having predetermined rigidity and constitutes a frame-work of the recording apparatus and serves to support (or hold) the above-mentioned various recording mechanisms and recovery operation mechanism. Further, the lower case M1001 forms a substantially lower half of the main body M1000, and the upper case M1002 forms a substantially upper half of the main body M1000, and, by combining these cases M1001 and M1002, a hollow structure for containing various mechanisms which will be described later therein is defined, and openings are formed in an upper surface and a front surface of the hollow structure, respectively.

Further, the paper discharge tray M1004 has one end rotatably held onto the lower case M1001 so that the opening formed in the front surface of the lower case can be opened and closed by rotation of the tray. Thus, when the recording operation is carried out, the paper discharge tray M1004 is rotated forwardly to open the opening, so that a recording sheet as a recording medium can be discharged through the opening and the recording sheets P can be stacked onto the tray successively. Further, two auxiliary trays M1004*a*, M1004*b* are contained in the paper discharge tray M1004 so that a supporting area for the paper (recording medium, recording sheet) can be increased or decreased with three stages by extending or retracting these auxiliary trays.

The access cover M1003 has one end rotatably held onto the upper case M1002 so that an access opening formed in an upper surface of the upper case can be opened and closed. With this arrangement, by opening the access cover M1003, a recording head cartridge H1000 as recording means or ink tanks H1900 contained within the main body can be exchanged. Incidentally, when the access cover M1003 is opened or closed, a projection (not shown) formed on a back surface of the cover rotates a cover opening/closing lever (not shown) so that, by detecting a rotated position of the lever by a microswitch or the like, an open condition or a closed condition of the access cover can be detected.

Further, on an upper rear surface of the upper case M1002, there are provided a power source key E0018 and a resume key E0019 which can be depressed and there is also provided an LED E0020, so that, when the power source key E0018 is depressed, the LED E0020 is turned ON to inform the operator of the fact that the recording operation can be performed. Further, the LED E0020 has various displaying functions, for example, for changing a flashing manner or changing color or actuating a buzzer E0021 (FIG. 11) to inform the operator of trouble of the printer. Incidentally, when the trouble is eliminated, the recording operation is re-started by depressing the resume key E0019.

Next, a recording operation mechanism according to the illustrated embodiment, contained and held in the main body M1000 of the recording apparatus will be explained. The recording operation mechanism according to the illustrated embodiment comprises an automatic feeding portion M3022 for automatically feeding the recording sheet P into the main body, a conveying portion M3029 (FIG. 3) for directing the recording sheet P successively fed out from the automatic feeding portion to a desired recording position and for directing the recording sheet P from the recording position to a discharging portion M3030 (FIG. 3), a recording portion M4000 for effecting desired recording on the recording sheet P conveyed by the conveying portion, and a recovery portion (recovery unit) M5000 (FIGS. 9 and 10) for effecting recovery process with respect to the recording portion M4000 and the like.

First of all, the automatic feeding portion M3022 will be fully described with reference to FIGS. 2 and 3. The automatic feeding portion M3022 according to the illustrated embodiment is designed so that recording sheets P stacked in a condition inclined with respect to a horizontal plane by an angle of about 30 to 60 degrees, may be fed out in a horizontal posture, and fed into the main body M1000 through a feed opening (not shown) while maintaining the recording sheet in the horizontal posture. That is to say, the automatic feeding portion M3022 is provided with a feed roller portion M3026, side guides M 3024, a pressure plate M3025, an ASF (auto sheet feeder) base M3023, separation sheets M3027, and a separation pawl (not shown). Among them, the ASF base M3023 substantially constitutes an outer frame of the automatic feeding portion M3022 and is provided at a back surface side of the main body M1000. Further, at a front surface side of the ASF, the pressure plate M3025 for supporting the recording sheet P is attached to be inclined with respect to the horizontal plane by an angle of about 30 to 60 degrees, and a pair of sheet guides (side guides) M3024*a*, M3024*b* are protruded from the pressure plate. One (M3024*b*) of the sheet guides can be slid in a horizontal direction so that a distance between the sheet guides can be adjusted to accommodate a horizontal side (width) of the recording sheet.

Further, at left and right sides of the ASF base M3023, a drive shaft M3026*a* driven in synchronous with a purge motor E0003 via a transmission gear (not shown) is rotatably supported, and a plurality of feed rollers M3026 having an irregular circumference shape are secured to the drive shaft M3026*a*. By rotating the feed roller portion M3026 by driving the purge motor E0003 (FIGS. 10 and 11), the recording sheets P stacked on the pressure plate M3025 are separated and fed out one by one from an uppermost recording sheet on the sheet stack by a separation action of the separation sheets M3027 and the separation pawl, and the separated recording sheet is conveyed to the conveying portion (sheet feeding portion) M3029. Incidentally, since a lower end of the pressure plate M3025 is elastically supported by pressure plate springs M3028 disposed between the plate and the ASF base M3023, an abutting force between the feed roller portion M 3026 and the recording sheet P can be kept constant regardless of the number of stacked recording sheets P.

Further, in a conveying path extending from the automatic feeding portion M3022 to the conveying portion M3029, an PE (paper end) lever M3020 biased in a clockwise direction (FIG. 3) by an PE (paper end) lever spring M3021 is rotatably supported onto a chassis M3019 comprised of a plate-shaped metallic member having predetermined rigidity and secured to the main body M1000. When the recording sheet P separated and fed from the automatic feeding portion M3022 passes through the conveying path and one end of the recording sheet urges one end of the lever M3020 to rotate the latter, an PE sensor (not shown) detects rotation of the PE lever M3020, so that the fact that the recording sheet P enters into the conveying path is detected. After the penetration of the recording sheet P into the conveying path is detected, the recording sheet P is conveyed by means of the feed roller portion M3026 toward a downstream direction by a predetermined distance. In the conveying operation of the feed roller portion M3026, after the end of the recording sheet P abuts against a nip between a line feed roller (conveying roller) M3001 (now stopped) and a pinch roller portion M3014 which are provided in the conveying portion M3029 (described later), the recording sheet P is stopped to have a loop of about 3 mm.

Next, the conveying portion M3029 will be fully described with reference to FIGS. 2 and 3. The conveying portion M3029 according to the illustrated embodiment includes the LF (line feed) roller (conveying roller) M3001, the pinch roller portion M3014 and a platen M2001. The LF roller M3001 is secured to a drive shaft rotatably supported onto the chassis M3019, and an LF intermediate gear M3012 is driven in synchronous with a drive gear provided on a drive shaft of an LF motor E0002 (described later) and is rotated by a driving force of the LF motor E0002. Incidentally, an LF gear cover M3002 is mounted on one end of the drive shaft to which the LF roller M3001 is secured. The LF gear cover M3002 serves to protect an LF gear train for driving the LF roller M3001. That is to say, the LF gear train is in synchronous with the drive gear provided on the drive shaft of the LF motor (conveying motor) E0002 and is rotated by the driving force of the LF motor E0002.

Further, the pinch roller portion M3014 is rotatably supported onto a tip end portion of a pinch roller holder M3015 rotatably supported by the chassis M3019 and is urged against the LF roller M3001 by a pinch roller coil spring M3016 for biasing the pinch roller holder M3015, and is rotatingly driven by the rotation of the LF roller M3001 so that it cooperates with the LF roller M3001 to pinch the recording sheet P which is now stopped in the looped condition therebetween and to convey the recording sheet forwardly. In the conveying portion M3029 constructed in this way, when a predetermined time period is elapsed after the conveying operation of the feed roller portion M3026 of the automatic feeding portion M3022 is stopped, the driving of the LF motor E0002 is started, and the driving force of the LF motor E0002 is transmitted to the LF roller M3001 via the LF intermediate gear M3012 and LF gear M3003, with the result that the recording sheet the leading end of which abuts against the nip between the LF roller M3001 and the pinch roller portion M3014 is conveyed to a record starting position on the platen M2001 by the rotation of the LF roller M3001. In this case, since the feed roller portion M3026 starts to rotate again simultaneously with the LF roller M3001, the recording sheet P is conveyed in the downstream conveying direction for a predetermined time period by the cooperation between the feed roller portion M3026 and the LF roller M3001.

Figure 4:
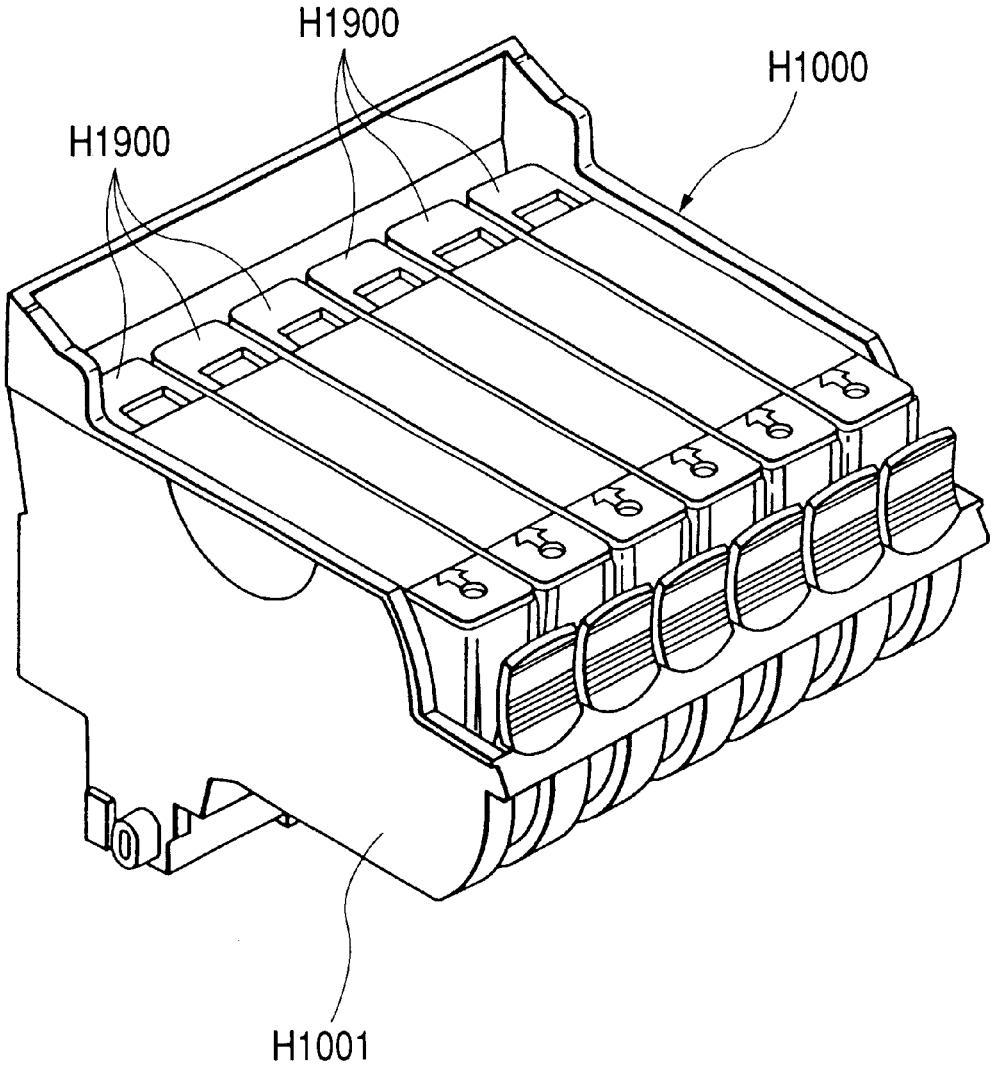
FIG. 4 is a schematic perspective view showing an entire construction of a recording head ink cartridge in which ink tanks are mounted to recording heads as recording means used in the ink jet recording apparatus according to the embodiment.
Figure 5:
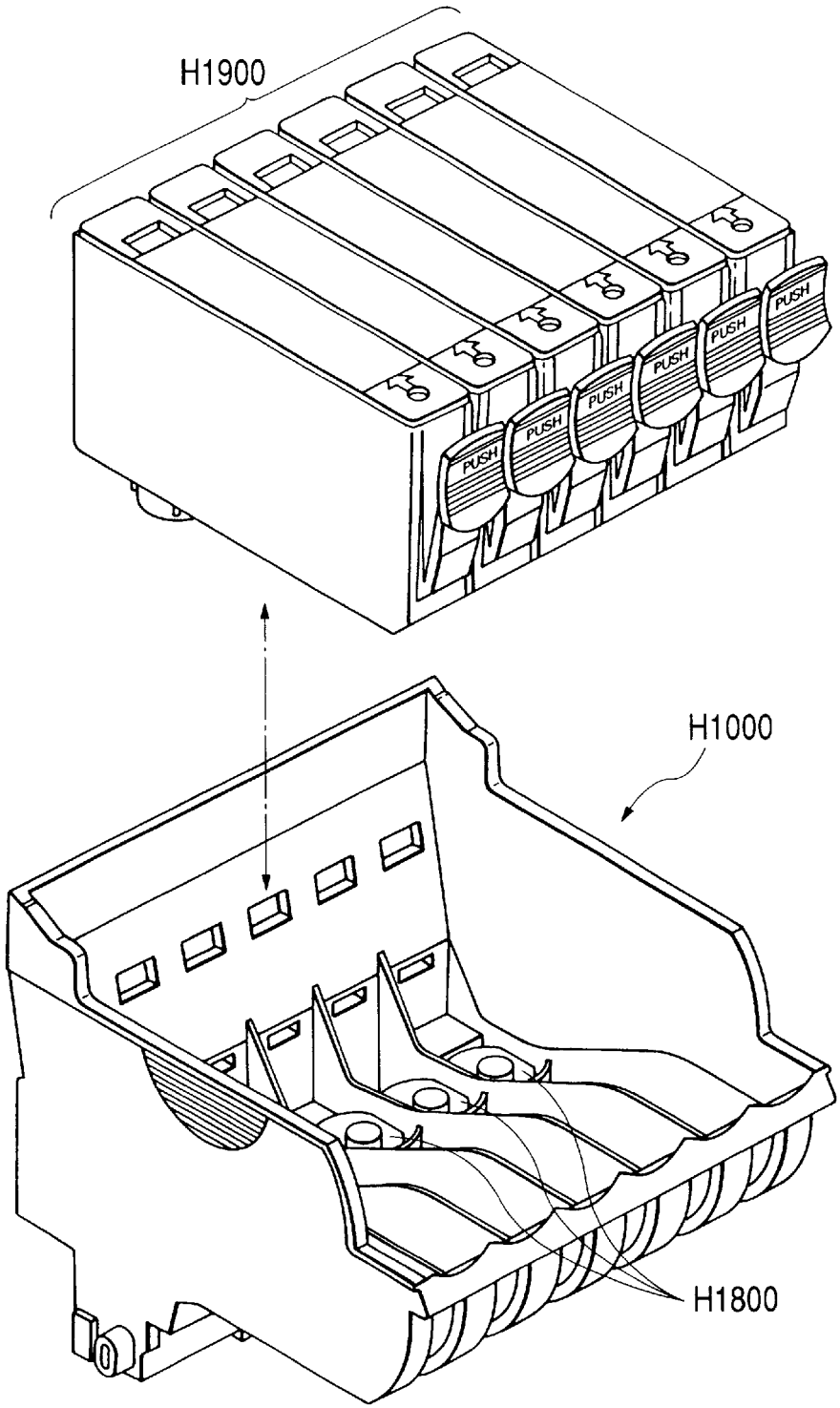
FIG. 5 is a schematic perspective view showing the recording heads and the ink tanks decomposed from the recording head cartridge of FIG. 4.
Figure 6:
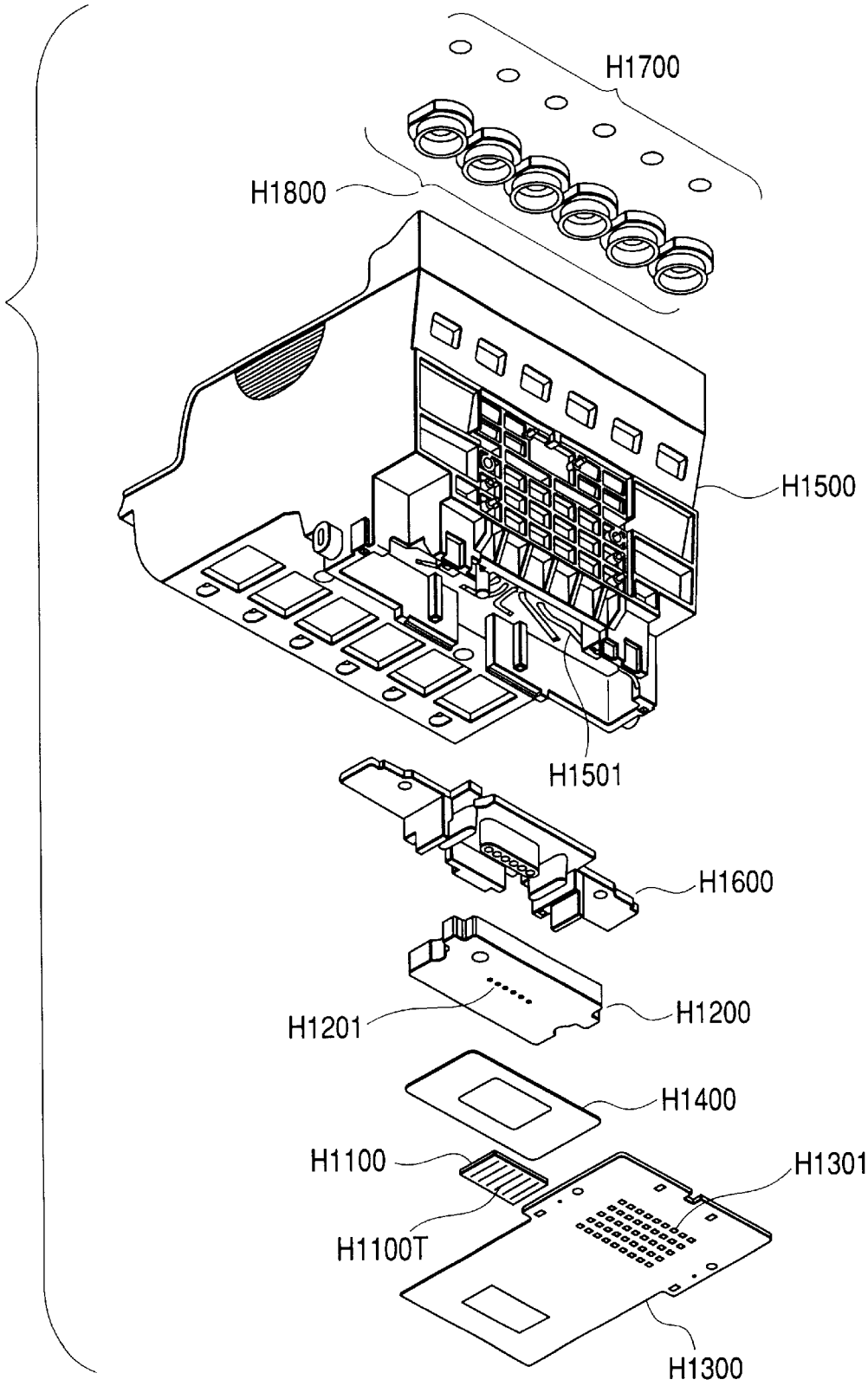
FIG. 6 is a schematic exploded perspective view showing constructural parts of the recording head as the recording means of FIG. 5.

FIG. 4 is a schematic perspective view showing an entire construction of a recording head cartridge which ink tanks are mounted to a recording head as recording means used in the ink jet recording apparatus according to the illustrated embodiment. FIG. 5 is a schematic perspective view of the recording head cartridge of FIG. 4 which is decomposed into the recording head and the ink tanks. FIG. 6 is a schematic exploded perspective view showing constructural elements of the recording head as the recording means of FIG. 5. The recording head cartridge H1000 as the recording means is detachably mounted to a carriage M4001. That is to say, the recording head cartridge H1000 is shifted together with the carriage M4001 reciprocally shifted in a direction (scanning direction) transverse to the conveying direction of the recording sheet P along a carriage shaft M4012 having both ends secured to the chassis M3019 and serves to record an ink image on the recording sheet P waited at the recording start position by discharging ink on the basis of predetermined image information.

After the ink image is recorded, predetermined amount conveyance (for example, conveyance of the recording sheet P at a line unit of 5.42 mm conveyance) is effected by the rotation of the LF roller M3001, and, after such conveyance is finished, the carriage M4001 effects the scanning along the carriage shaft M4012. By repeating such recording and conveyance, the recording of the ink image is carried out with respect to the recording sheet P positioned on the platen M2001. Further, regarding the carriage shaft M4012, one end thereof is mounted to a sheet-to-sheet adjusting plate (not shown) via a sheet-to-sheet adjusting lever M2015 and the other end is mounted to the other sheet-to-sheet adjusting plate M2012 via a carriage shaft cam M2011 in a biased condition provided by a carriage shaft spring M2014. The sheet-to-sheet adjusting plate M2012 and the sheet-to-sheet adjusting plate (not shown) are adjusted to provide a proper distance between a discharge port face of the recording head cartridge H1000 and a record supporting surface M2001*a* of the platen M2001 and then are secured to the chassis M3019.

Further, the sheet-to-sheet adjusting lever M2015 can selectively be set at two stop positions, i.e., an upper end position shown in FIG. 1 and a lower end position (not shown), by the action of a sheet-to-sheet lever spring (not shown). When the sheet-to-sheet adjusting lever M2015 is shifted to the lower end position, the carriage M4001 is shifted in a direction away from the platen M2001 by about 0.6 mm. When the recording sheet P is a thick sheet such as an envelope, the sheet-to-sheet adjusting lever M2015 is previously shifted to the lower end position and then the feeding operation of the automatic feeding portion M3022 is started. Further, when the sheet-to-sheet adjusting lever M2015 has already been shifted to the lower end position, since a sheet-to-sheet sensor (gap sensor) E0008 (refer to FIG. 11) detects such a condition, when the feeding operation of the automatic feeding portion M3022 for the recording sheet P is started, it is judged whether the position setting of the sheet-to-sheet adjusting lever M2015 is proper or not. If an improper condition is detected, alarm is issued by displaying a message or operating a buzzer, thereby preventing the recording operation from being performed in the improper condition.

Next, the paper discharge portion M3030 will be fully described with reference to FIGS. 2 and 3. As shown in FIG. 3, the paper discharge portion M3030 according to the illustrated embodiment includes a paper discharge roller M2003, a paper discharge gear M3013 mounted to the paper discharge roller M2003 and adapted to transmit the driving force of the LF motor E0002 to the paper discharge roller M2003 via the LF intermediate gear M3012, a first spur roller M2004 urged against the paper discharge roller M2003 by a biasing force of a spur spring shaft M2009 attached to a first spur holder M2007 mounted to a spur stay M2006 and rotatingly driven by rotation of the paper discharge roller M2003 and adapted to convey the recording sheet P while pinching the recording sheet between the first spur roller and the paper discharge roller M2003, and a paper discharge tray M1004 on which the discharge recording sheets P are stacked.

Although the recording sheet conveyed to the paper discharge portion M3030 is subjected to a conveying force of the paper discharge roller M2003 and the first spur roller M2004, since the rotational center of the first spur roller M2004 is offset from the rotational center of the paper discharge roller M2003 by about 2 mm upstream in the conveying direction, the recording sheet P conveyed by the paper discharge roller M2003 and the first spur roller M2004 is lightly contacted with the recording sheet supporting surface M2001*a* of the platen M2001 without any gap therebetween, thereby conveying the recording sheet properly and smoothly.

Further, in order to prevent the slack of the recording sheet P, the conveying force of the paper discharge roller M2003 and the first spur roller M2004 is set to be slightly greater than a conveying force of the LF roller M3001 and the pinch roller portion M3014. Further, the spur stay M2006 holds a second spur roller M2005 disposed at a downstream side of the first spur roller M2004 and mounted to a second spur holder M2008, thereby preventing the recording sheet P from being slidingly contacted with the spur stay M2006. After the ink image is recorded on the recording sheet P, when the trailing end of the recording sheet P leaves the nip between the LF roller M3001 and the Pinch roller portion M3014, the recording sheet P is conveyed only by the paper discharge roller M2003 and the first spur roller M2004, and the discharging of the recording sheet P is completed.

Next, the recording portion M4000 will be fully described. The recording portion M4000 comprises the carriage M4001 shiftably guided and supported by the carriage shaft M4012, and the recording head cartridge H1000 as the recording means detachably mounted to the carriage M4001. First of all, the recording head cartridge H1000 will be explained with reference to FIGS. 4 to 6. As shown in FIG. 4, the recording head cartridge H1000 according to the illustrated embodiment has ink tanks H1900 for storing inks and a recording head H1001 for discharging the ink supplied from the ink tank H1900 in response to recording information, and the recording head H1001 is of so-called cartridge type detachably mounted to the carriage M4001 which will be described later.

Figure 7:
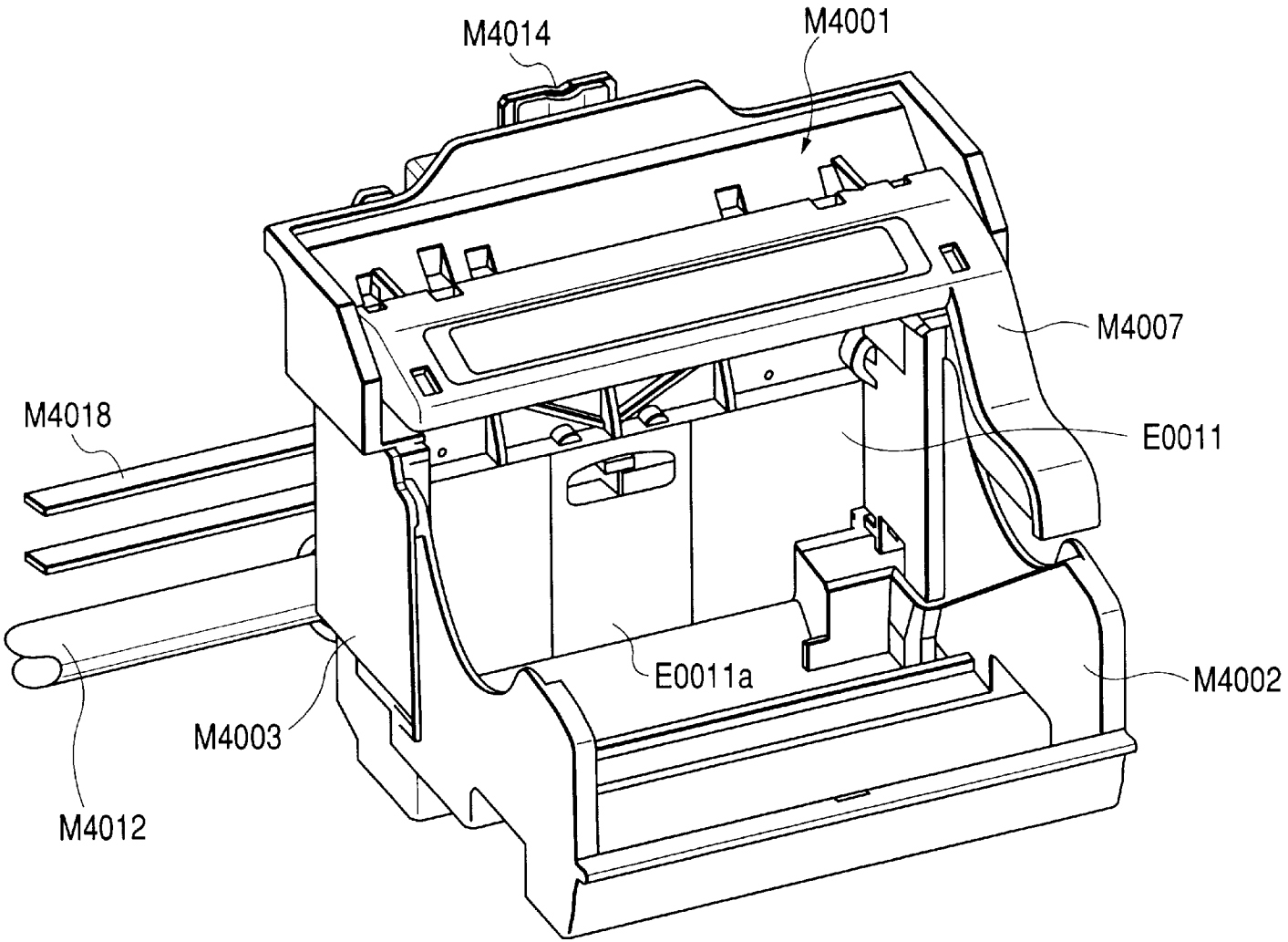
FIG. 7 is a schematic perspective view showing a carriage used in the ink jet recording apparatus according to the embodiment, looked at from a front side.

In the recording head cartridge H1000 disclosed here, in order to permit high quality color recording like photograph, as the ink tanks, for example, there are prepared color ink tanks for independent colors such as black, light cyan, light magenta, cyan, magenta and yellow, and, as shown in FIG. 7, the respective ink tanks are detachable with respect to the recording head H1001. As shown in the exploded perspective view of FIG. 6, the recording head H1001 is constituted by a recording element substrate H1100, a first plate H1200, an electrical wiring substrate H1300, a second plate H1400, a tank holder H1500, a flow path forming member H1600, filters H1700 and rubber seals H1800. A plurality of recording elements for discharging the ink and Al (aluminum) electrical wirings for supplying electric power to the recording elements are formed on one surface of an Si substrate (silicon substrate) of the recording element substrate H1100 by a film forming technique. A plurality of ink flow paths and a plurality of discharge ports H1100T (discharge ports 1182) which corresponds to the recording elements are formed by a photo-lithography technique, and ink supply ports for supplying the inks to the plural ink flow paths are formed to be opened to the back surface of the substrate.

Further, the recording element substrate H1000 is securely welded to the first plate H1200, and ink supply ports H1201 for supplying the inks to the recording element substrate H1100 are formed in the first plate H1200. Further, the second plate H1400 having an opening is securely welded to the first plate H1200, and the second plate H1400 holds the electrical wiring substrate H1300 so that the electrical wiring substrate H1300 is electrically connected to the recording element substrate H1100. The electrical wiring substrate H1300 serves to apply to the recording element substrate H1100 an electrical signal for causing the discharging of the ink and has electrical wirings corresponding to the recording element substrate H1100, and external signal input terminals (contact portions) H1301, disposed at ends of the electrical wirings, for receiving electrical signals from the main body. The external signal input terminals H1301 are positioned and secured to the back surface of the tank holder H1500.

On the other hand, the flow path forming member H1600 is welded to the tank holder H1500 for detachably holding the ink tanks H1900, by ultrasonic welding, so that ink paths H1501 extending from the ink tanks H1900 to the first plate H1200 is formed. Further, the filters H1700 are provided at ink tank side ends of the ink flow paths H1501 engaged by the ink tanks H1900, thereby preventing external dirt and contaminants from entering into the flow paths. Further, the rubber seals H1800 are provided at the engagement portions with the ink tanks H1900, thereby preventing the ink from being evaporated through the engagement portions. Further, by joining the tank holder portion comprised of the tank holder H1500, the flow path forming member H1600, the filters H1700 and the rubber seals H1800 as mentioned above to the recording element portion (ink discharge portion) comprised of the recording element substrate H1100, the first plate H1200, the electrical wiring substrate H1300 and the second plate H1400 by welding, the recording head H1001 is formed.

Figure 8:
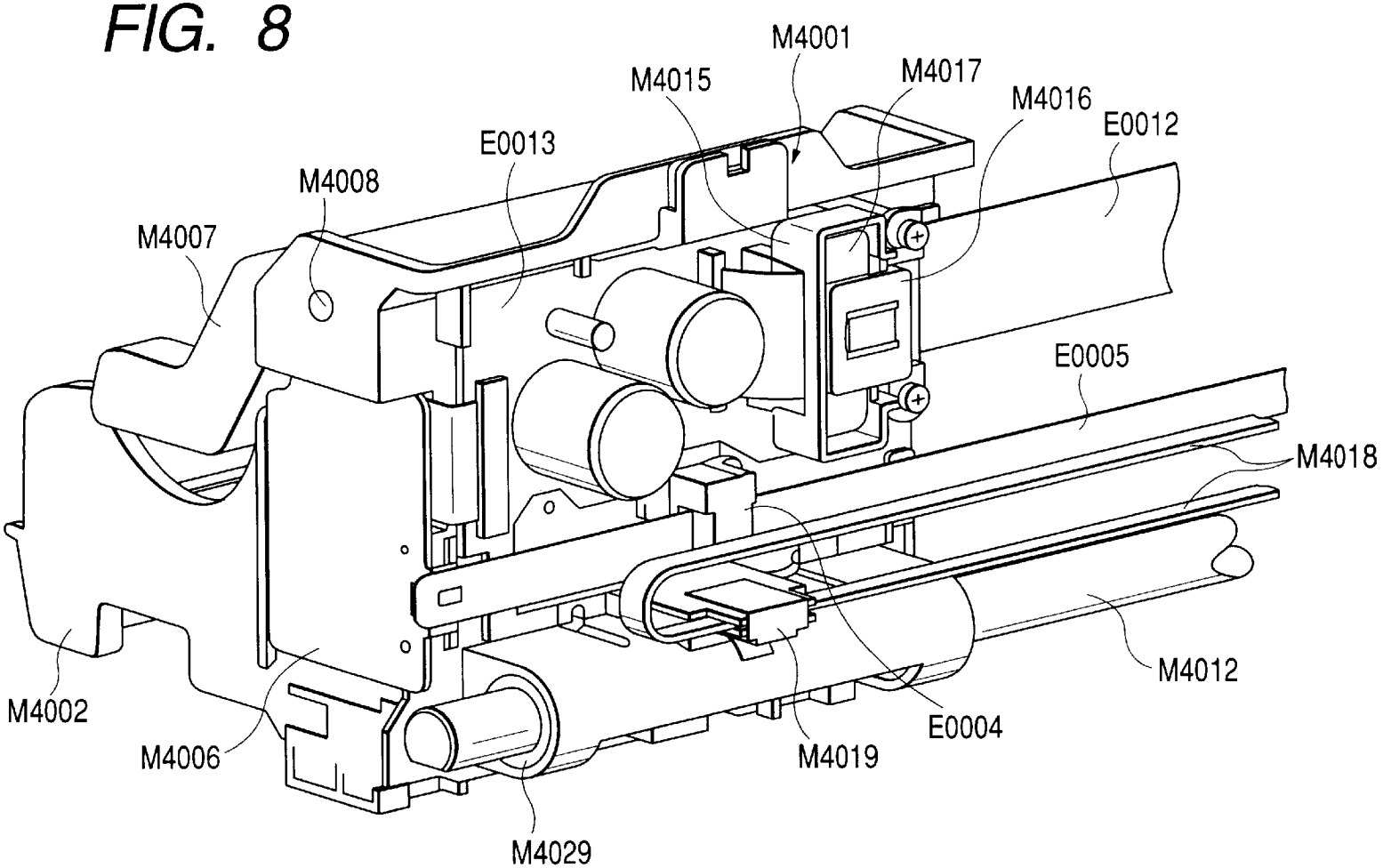
FIG. 8 is a schematic perspective view of the carriage of FIG. 7, looked at from a rear side.

FIG. 7 is a schematic perspective view showing a front side of the carriage mounted to the ink jet recording apparatus according to an embodiment of the present invention, and FIG. 8 is a schematic perspective view showing a back side of the carriage of FIG. 7. Next, the carriage M4001 will be described with reference to FIGS. 2, 7 and 8. As shown in these drawings, the carriage M4001 is provided with a carriage cover M4002 engaged by the carriage and adapted to guide the recording head H1001 to a mounting position on the carriage, and a head set lever M4007 engaged by the tank holder H1500 of the recording head H1001 and adapted to urge the recording head to set the recording head at a predetermined mounting position.

That is to say, the head set lever M4007 is rotatably provided on a head set lever shaft M4008 at an upper part of the carriage M4001, and a head set plate (not shown) is mounted to an engagement portion with the recording head H1001 via a spring. With this arrangement, the recording head H1001 is mounted to the carriage M4001 while being urged by a spring force of the spring. Further, another engagement portion (of the carriage) with the recording head H1001 of the carriage M4001 is provided with a contact flexible print cable (referred to as "contact FPC" hereinafter) E0011, and, by electrically contacting contact portions E0011*b* on the contact FPC E0011 with the contact portions (external signal input terminals) H1301 of the recording head H1001, the receiving of various informations for the recording and the supplying of the electric power to the recording head H1001 can be effected.

Here, an elastic member (not shown) such as rubber is provided between the contact portions E0011*a* of the contact flexible print cable (contact FPC) E0011 and the carriage M4001, so that the contact portions E0011*a* are positively contacted with the carriage M4001 by an elastic force of the elastic member and an urging force of the head set lever spring. Further, the contact FPC E0011 is extended beyond both sides of the carriage M4001, and, as shown in FIGS. 7 and 8, both end portions of the cable are pinched and secured to the both sides of the carriage M4001 by a pair of FPC pressing members M4003, M4006 and are connected to a carriage substrate E0013 (refer to FIG. 8) mounted to the back surface of the carriage.

Figure 11:
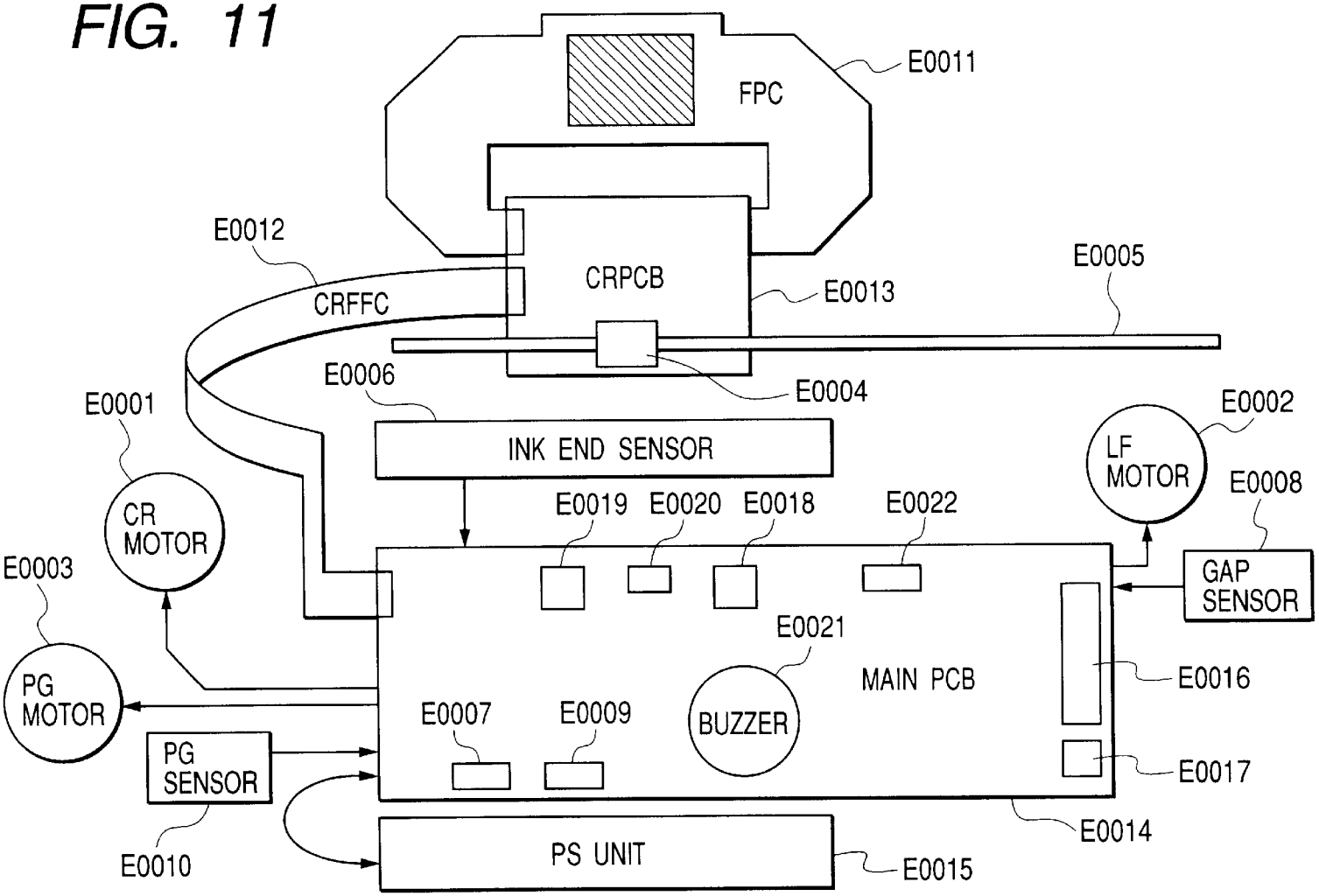
FIG. 11 is a block diagram showing an entire construction of an electrical circuit of the ink jet recording apparatus according to the embodiment.

Further, as shown in FIG. 8, the carriage substrate E0013 is electrically connected to a main substrate E0014 provided on the chassis M3019 via a carriage flexible flat cable (CRFFC) E0012. Further, the other end of the carriage flexible flat cable E0012 is secured to the chassis M3019 (FIG. 2) by an FFC pressing member M4028, and is extended toward the back surface side through a hole (not shown) formed in the chassis to be connected to the main substrate E0014 (FIG. 11). As shown in FIGS. 8 and 11, the carriage substrate E0013 is provided with an encoder sensor E0004. By detecting information on an encoder scale E0005 provided, in parallel with the carriage shaft M4012, between both side surfaces of the chassis M3019, the position and scanning speed of the carriage M4001 can be detected.

In the illustrated embodiment, the encoder sensor E0004 is an optical sensor of permeable type, and the encoder scale E0005 is formed by alternately and at a predetermined pitch printing light shielding portions for shielding detection light from the encoder sensor E0004 and light permeable portions for permitting the passage of the detection light on a film made of resin such as polyester by a technique such as photographic process. Accordingly, the position of the carriage M4001 shifted along the carriage shaft M4012 can be detected at any time by using, as a reference, a position of the carriage at the time when the carriage abuts against one of side plates of the chassis M3019 provided at ends on the scanning track of the carriage M4001, and counting the number of patterns formed on the encoder scale E0005 by the encoder sensor E0004 as the carriage M4001 scans.

Further, the carriage M4001 performs the scanning while being guided by the carriage shaft M4012 and a carriage rail M4013 provided between both sides of the chassis M3019, and a pair of carriage bearings M4029 obtained by impregnating lubricant such as oil into sintered metal are integrally formed with a bearing portions of the carriage shaft M4012 by insert-molding or the like. Further, at an abutting portion between the carriage M4001 and the carriage rail M4013, there is provided a carriage slider (CR slider) M4014 as an abutting member made of resin having excellent sliding ability and anti-wear property, which slider cooperates with the carriage bearings (CR bearings) M4029 to permit smooth scanning of the carriage M4001.

Further, the carriage M4001 is connected to a carriage belt (timing belt) M4018 provided in substantially parallel with the carriage shaft M4012 between an idler pulley M4020 (FIG. 2) and a carriage motor pulley M4024 (FIG. 2), so that, by shifting the carriage belt M4018 in a forward or rearward direction by driving the carriage motor pulley M4024 by means of the carriage motor E0001 (FIGS. 2 and 11), the carriage M4001 can be scanned along the carriage shaft M4012. Further, the carriage motor pulley M4024 is held at a fixed position by the chassis M3019; whereas, the idler pulley M4020 is shiftably held together with a pulley holder M4021 with respect to the chassis M3019 and is biased toward a direction away from the motor pulley M4024 by a spring force. Thus, proper or moderate tension is always applied to the carriage belt M4018 mounted between the pulleys M4020 and M4024, thereby maintaining a good mounting condition having no slack.

Incidentally, a carriage belt stop M4019 is provided at an attachment portion between the carriage M4001 and the carriage belt M4018, so that the carriage M4001 can positively be connected (attached) to the carriage belt M4018. Further, in the scanning track or path of the carriage M4001 on the spur stay M2006, there is provided an ink end sensor E0006 (FIG. 11) exposed and opposed with respect to the ink tanks in order to detect the remaining amount of inks stored in the ink tanks H1900 of the recording head cartridge H1000 mounted to the carriage.

The recording head H1001 as the recording means according to the illustrated embodiment is ink jet recording means adapted to discharge the ink by utilizing thermal energy and having electrical/thermal converters for generating the thermal energy. Further, the head H1001 serves to effect the recording (printing) by discharging the ink from the discharge port by utilizing change in pressure due to growth and contraction of a bubble generated by film boiling caused in the ink by the thermal energy applied by the electrical/thermal converter.

Figure 24:
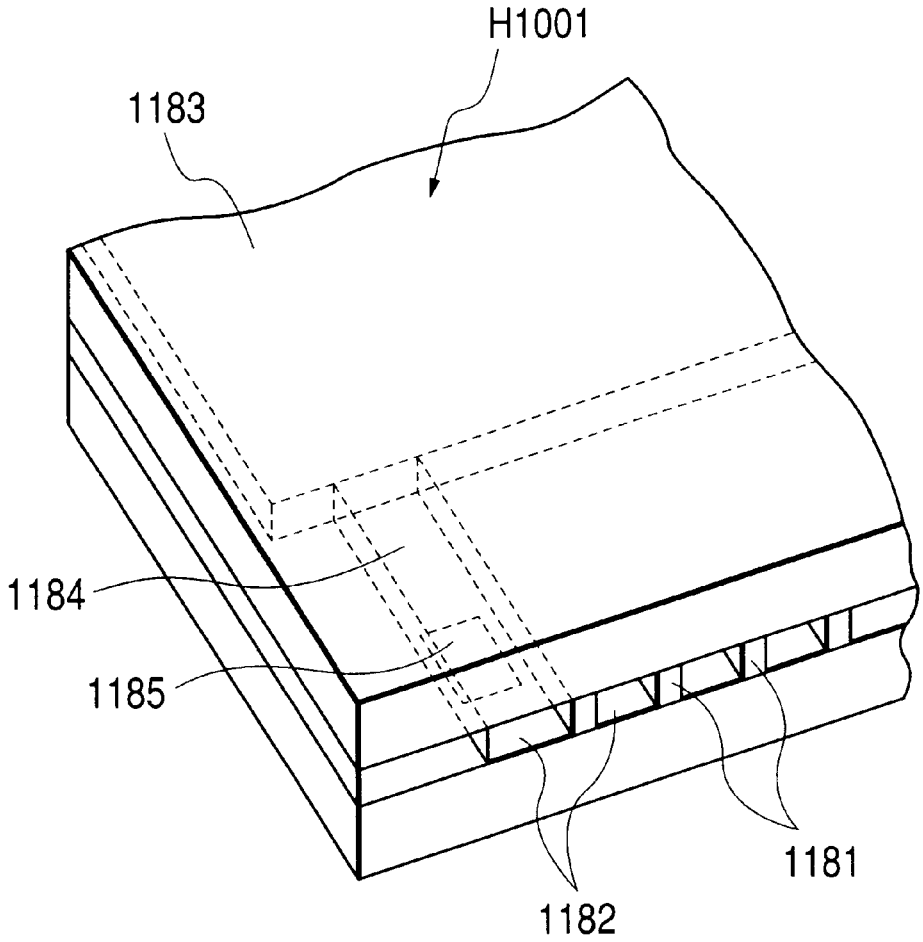
FIG. 24 is a partial perspective view schematically showing a structure of an ink discharge portion of the recording means of FIG. 4.

FIG. 24 is a partial perspective view schematically showing a structure of the ink discharge portion including a discharge port array of the recording head H1001. In FIG. 24, in a discharge port face 1181 (corresponding to the recording element substrate H1100) opposed to the recording medium P such as the recording paper with a predetermined gap (for example, about 0.2 mm to about 2.0 mm) therebetween, a plurality of discharge ports 1182 (corresponding to the discharge ports H1100T) are formed with a predetermined pitch, and electrical/thermal converters (such as heat generating resistance bodies) 1185 for generating ink discharging energy are disposed along wall surfaces of liquid paths 1184 communicating a common liquid chamber 1183 with the discharge ports 1182. The recording head H1001 is mounted to the carriage M4001 in such a manner that the discharge ports 1182 are positioned side by side in a direction transverse to the main scanning direction (shifting direction of the carriage M4001). As such, there is provided the recording head (recording means) H1001 of ink jet type in which the electrical/thermal converter 1185 is driven in response to an image signal or a discharge signal to cause the film boiling in the ink within the liquid path 1184 and the ink is discharged from the discharge port 1182 by the pressure generated by the film boiling.

Figure 9:
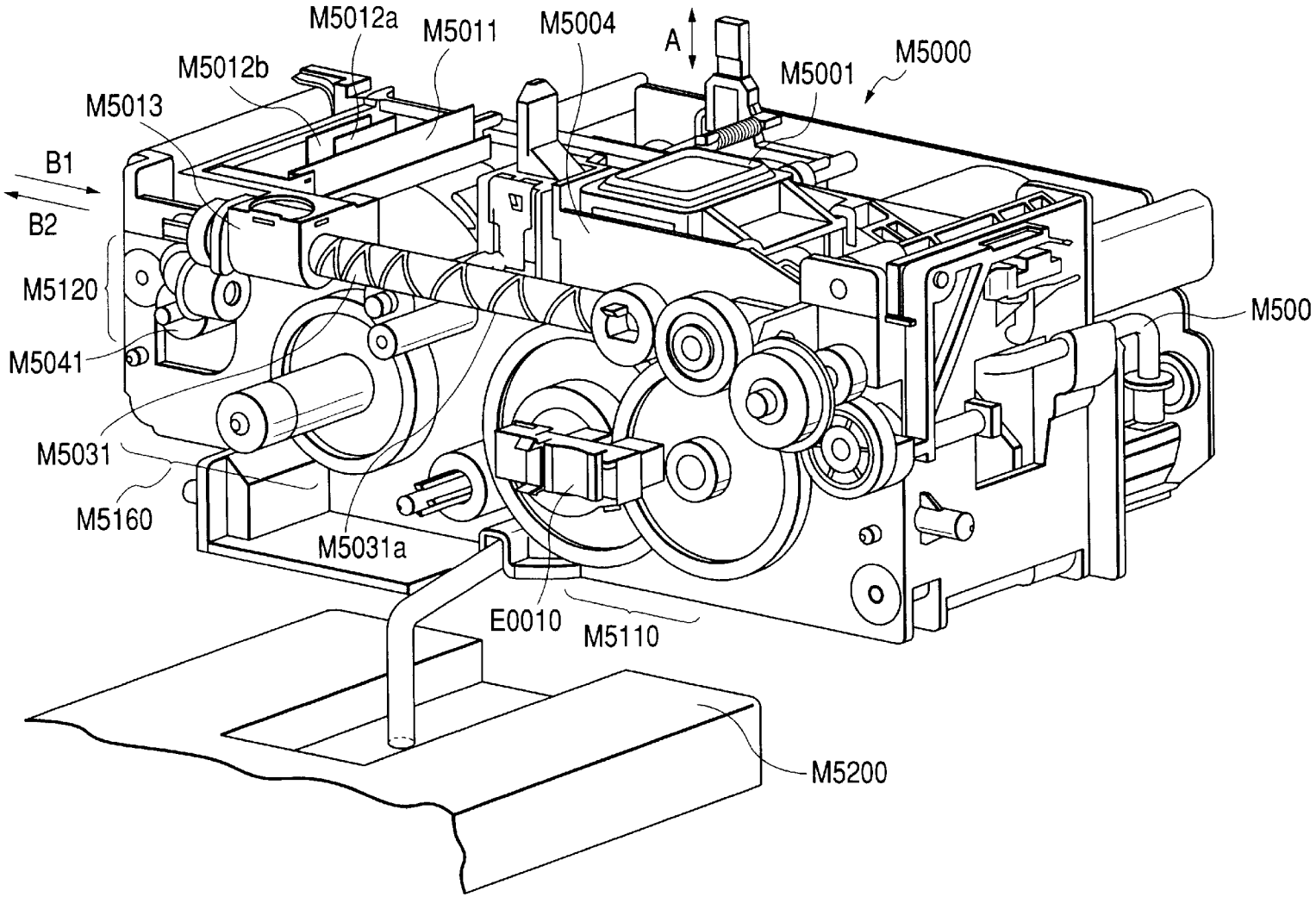
FIG. 9 is a schematic perspective view showing an entire construction of a recovery unit mounted to the ink jet recording apparatus according to the embodiment.
Figure 10:
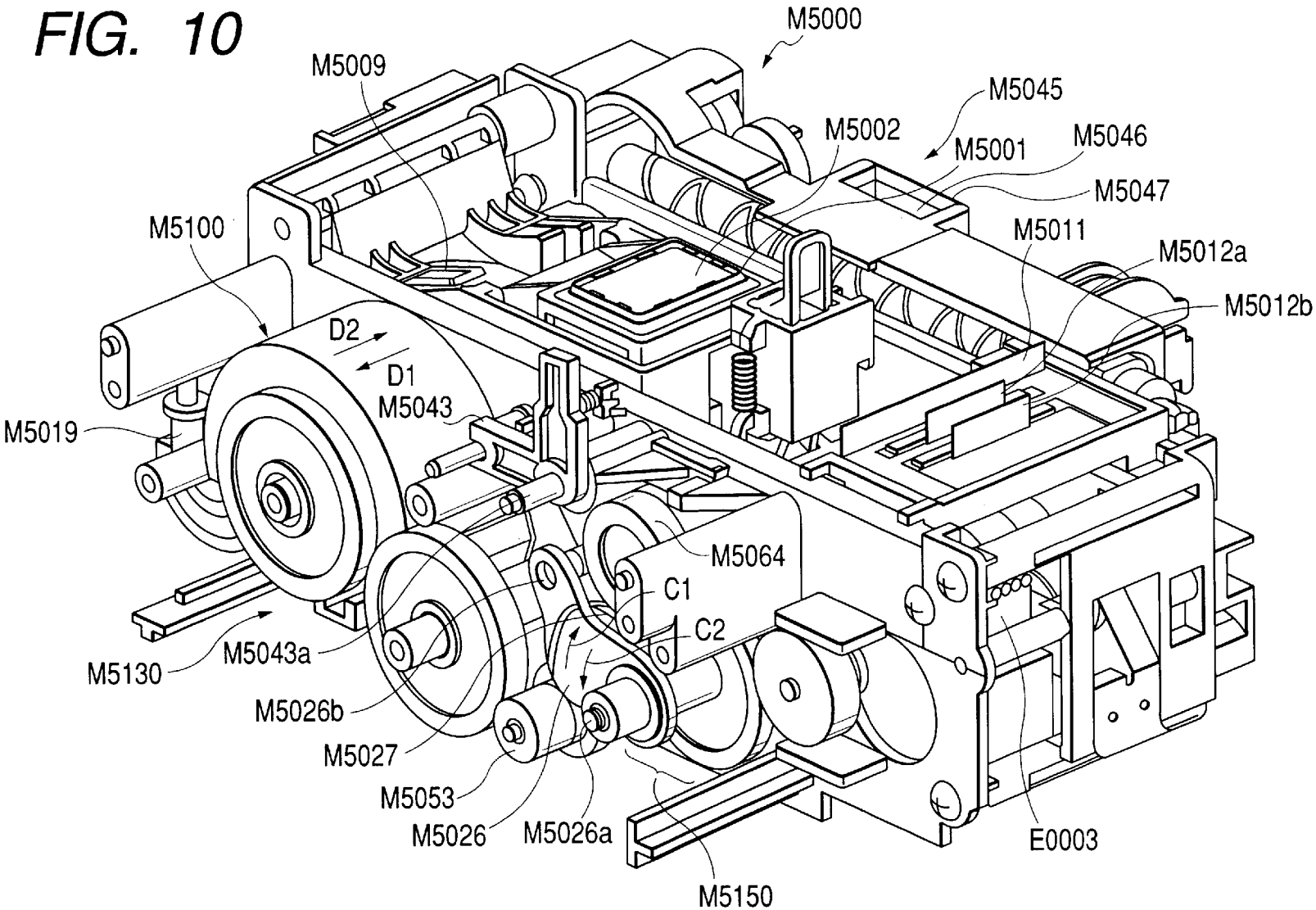
FIG. 10 is a schematic perspective view showing the entire construction of the recovery unit, looked at from another side.

FIG. 9 is a schematic perspective view showing an entire construction of the recovery unit mounted to the ink jet recording apparatus according to the embodiment of the present invention, and FIG. 10 is a schematic perspective view showing the entire construction of the recovery unit of FIG. 9, looked at from a different direction. Next, the recovery unit M5000 constituting the recovery portion for effecting recovery process for recovering and maintaining ink discharging performance of the recording head cartridge H1000 will be explained with reference to FIGS. 9 and 10. The recovery portion (recovery unit) M5000 according to the illustrated embodiment is designed to be detachable with respect to the main body M1000 independently. The recovery unit M5000 is constituted by recovery process means comprising a cleaning mechanism for removing foreign matters adhered to the recording element substrate (discharge port forming face) of the recording head H1001, and a discharging mechanism for effecting suction discharge or pressurized discharge (pre-ejection) for discharging the ink in order to normalize (refresh the ink) the ink flow paths extending from the ink tanks H1900 to the recording element substrate H1100 of the recording head H1001 (flow paths extending from the ink flow paths H1501 to the second plate H1400 through the flow path forming member H1600).

In FIGS. 9 and 10, the purge motor E0003 serves as a recovery driving source for driving a cap M5001, a pump M5100 and wiper blades M5011, M5012*a,* M5012*b* which will be described later. Incidentally, in the illustrated embodiment, the purge motor E0003 also serves as a driving source for driving the automatic feeding portion M3022. In the purge motor E0003, a driving force is picked up from both sides of a motor shaft, and the driving force at one side drives the pump M5100 or the automatic feeding portion M3022 via drive switching means (described later) and the driving force at the other side drives the cap M5001 and the wiper blades M5011, M5012*a,* M5012*b* via a one-way clutch M5041. In this case, only when the purge motor E0003 is rotated in a specific rotational direction (referred to as "normal direction" hereinafter; whereas, an opposite direction is referred to as "reverse direction"), the one-way clutch M5041 is engaged to drive the cap M5001 and the wiper blades M5011, M5012*a,* M5012*b*. Accordingly, when the purge motor E0003 is being rotated in the reverse direction, since the one-way clutch M5041 is rotated idly not to transmit the driving force, the cap M5001 and the wiper blades M5011, M5012*a,* M5012*b* are not driven.

The cap M5001 is formed from rubber material and is attached to a cap lever M5004 rotatable around an axis. The cap M5001 is shifted in directions shown by the arrow A (FIG. 9) via the one-way clutch M5041, a cap drive transmission gear train M5110, a cap cam and the cap lever M5004 so that the cap can abut against the recording element substrate H1100 of the recording head H1001 to cover the plural discharge ports H1100T (discharge ports 1182) or the cap can be separated from the recording element substrate. The cap M5001 is provided with a cap absorbing member M5002, and the cap absorbing member M5002 is disposed to be opposed to the recording element substrate H1100 with a predetermined gap therebetween in a capping condition.

By providing the cap absorbing member M5002, during the suction operation, the ink discharged from the discharge ports H1100T (discharge ports 1182) of the recording head cartridge H1000 can be received. A cap tube M5009 is connected to the cap M5001, and the cap tube M5009 is connected to a pump tube M5019 of the pump M5100 (described later) to discharge the ink from a cap suction port M5001*a* (refer to FIGS. 14 to 16).

Further, the wiper blades M5011, M5012*a,* M5012*b* are formed from flexible members made of rubber and are attached to a blade holder M5013 in such a manner that end edge portions of the blades are protruded upwardly. Further, a lead screw M5031 is inserted through the blade holder M5013, and a projection (not shown) of the blade holder M5013 is shiftably engaged by a helical groove M5031*a* formed in the lead screw. Thus, as the lead screw M5031 is rotated to rotate the blade holder M5013, the blade holder M5013 is reciprocally shifted in directions shown by the arrows B1 and B2 (FIG. 9), with the result that the wiper blades M5011, M5012*a,* M5012*b* wipe and clean (wiping) the recording element substrate H1100 (discharge port face 1181) of the recording head cartridge H1000. The lead screw M5031 is connected to the purge motor E0003 via the one-way clutch M5041 and a wiper driving transmitting gear train M5120.

The pump M5100 is a suction pump for generating pressure (negative pressure) by squeezing the pump tube M5019 by means of a pump roller M5018. The pump M5100 is connected to the other side of the purge motor E0003 via drive switching means for switching a driving force transmitting path between the automatic feeding portion M3022 and the pump M5100 and a pump drive transmitting gear train M5130. Further, although not described in detail, the pump M5100 is provided with a mechanism capable of releasing an urging force of the pump roller M5018 (against the pump tube) for squeezing the pump tube M5019, so that, when the purge motor E0003 is rotated in the normal direction, the urging force of the pump roller M5018 is released not to squeeze the pump tube M5019, and, when the purge motor E0003 is rotated, in the reverse direction, the urging force of the pump roller M5018 squeezes the pump tube M5019. Further, one end of the pump tube M5019 is connected to the cap M5001 via the cap tube M5009.

The driving switching means comprises a pendulum arm M5026 and a switching lever M5043. The pendulum arm M5026 is designed to rotate in a direction shown by the arrow C1 (FIG. 10) or a direction shown by the arrow C2 around a shaft M5026*a* in accordance with the rotational direction of the purge motor E0003. Further, the switching lever M5043 is switched in accordance with the position of the carriage M4001. That is to say, when the carriage M4001 is shifted above the recovery unit M5000, a part of the switching lever M5043 abuts against a part of the carriage M4001 to shift the switching lever M5043 in a direction shown by the arrow D1 (FIG. 10) or in a direction shown by the arrow D2 in accordance with the position of the carriage M4001, with the result that a lock pin M5043*a* of the switching lever M5043 can be fitted into a lock hole M5026*b* of the pendulum arm M5026. Incidentally, a purge sensor E0010 serves to detect the position of the cap M5001.

Next, an operation of the recovery unit M5000 having the above-mentioned construction will be explained. First of all, an operation of the automatic feeding portion M3022 effected also by using the purge motor as the driving source of the recovery unit M5000 will be described. In a condition that the carriage M4001 is in a retard (or retired) position where the carriage does not abut against the switching lever M5043, when the purge motor E0003 is rotated in the reverse direction, the pendulum arm M5026 is rocked in the direction C1 (FIG. 10) via a pendulum drive transmitting gear train M5150, with the result that a switching output gear M5027 attached to the pendulum arm M5026 is engaged with an ASF gear M5064 provided at one end of ASF drive transmitting gear train M5160. In this condition, when the purge motor E0003 continues to rotate in the reverse direction, the automatic feeding portion M3022 is driven via the ASF drive transmitting gear train M5160. In this case, since the driving force is not transmitted to the cap M5001 and the wiper blades M5011, M5012*a,* M5012*b* due to the idle rotation of the one-way clutch M5041, the wiper blades are not driven.

Next, a suction recovery operation which is one of recovery processes of the recovery unit M5000 having the above-mentioned construction will be explained. The suction recovery operation is performed by using the pump M5100. First of all, in the condition that the carriage M4001 is in the retard position where the carriage does not abut against the switching lever M5043, when the purge motor E0003 is rotated in the normal direction, the pendulum arm M5026 is rocked in the direction C2 via the pendulum drive transmitting gear train M5150, with the result that the switching output gear M5027 attached to the pendulum arm M5026 is engaged with the pump gear M5053 provided at one end of the pump drive transmitting gear train M5130. Thereafter, when the carriage M4001 is shifted to a capping position (carriage position where the recording element substrate (discharge port face) H1100 of the recording head cartridge H1000 is opposed to the cap M5001), a part of the carriage M4001 abuts against a part of the switching lever M5043 to rotate the switching lever M5043 in the direction D1. As a result, since the lock pin M5043*a* of the switching lever M5043 is fitted into the lock hole M5026*b* of the pendulum arm M5026, the pendulum arm M5026 is locked in a condition that it is connected to the pump.

Here, when the purge motor E0003 is rotated in the reverse direction to squeeze the pump tube M5019 by the urging force of the pump roller M5018, the negative pressure is applied to the recording element substrate H1100 (discharge port face 1181) of the recording head cartridge H1000, with the result that ink not suitable for the recording (ink including solidified ink and the like) and bubbles are forcibly sucked from the discharge ports 1102 of the recording element substrate. Thereafter, when the purge motor E0003 is rotated in the inverse direction, the pressure in the cap tube M5009 and the cap M5001 is returned to the atmospheric pressure, and the forcible suction operation from the ink discharge ports 1182 of the recording element substrate H1100 of the recording head cartridge H1000 is stopped, thereby finishing the suction operation.

Next, a wiping operation of the recovery unit M5000 having the above-mentioned construction will be explained. In the wiping operation, the purge motor E0003 is firstly rotated in the normal direction. Due to the normal rotation of the purge motor E0003, the wiper blades M5011, M5012*a,* M5012*b* are shifted to a wiping start position (position where the wiper blades M5011, M5012*a,* M5012*b* are positioned at an upstream side of the recording head cartridge (in the recording operation) in a condition that the cap M5001 is spaced apart from the recording head cartridge H1000 (recording head H1001)).

Then, the carriage M4001 is shifted to the wiping position. The wiping position is a position where the wiper blades M5011, M5012*a,* M5012*b* are opposed to the recording element substrate H1100 forming the discharge port face (discharge port forming face) 1181. In this case, the carriage M4001 does not abut against the switching lever M5043, and the pendulum arm M5026 is not locked. Here, the purge motor E0003 is rotated in the normal direction, with the result that the wiper blades M5011, M5012*a,* M5012*b* wipe and clean (cleaning) the recording element substrate H1100 of the recording head cartridge H1000 while shifting in the direction B1 (FIG. 9). Further, contaminants adhered to the wiper blades M5011, M5012*a,* M5012*b* are removed (cleaned) by wiper blade cleaning means (not shown) provided at a downstream side of the recording element substrate H1100 of the recording head cartridge H1000 in the recording operation direction. In this case, the cap M5001 is maintained (held) in the spaced apart condition.

When the wiper blades M5011, M5012*a,* M5012*b* reach a wiping finish position (downstream end position in the recording operation direction), the purge motor E0003 is stopped, and the carriage M4001 is shifted to a wiping retard position (out of a range through which the wiper blades M5011, M5012*a,* M5012*b* are shifted). Thereafter, the purge motor E0003 is rotated in the normal direction to shift the wiper blades M5011, M5012*a,* M5012*b* to the wiping finish position. Incidentally, also in this case, the cap M5001 is maintained in the spaced apart condition. In this way, the wiping operation of the recovery unit M5000 is finished.

Next, pre-ejection which is one of the recovery processes of the ink jet recording apparatus according to the illustrated embodiment will be explained. If the suction operation and/or the wiping operation are effected with respect to the recording head for effecting the recording by discharging plural color inks, there may arise a problem regarding mixing of inks. For example, when the suction operation is finished, there may arise a phenomenon that the inks sucked from the ink discharge ports by the suction flow reversely with respect to the recording head H1001 being under the negative pressure due to the suction, and, in this case, other color ink may enter into different color discharge port 1182 or various color inks adhered around the discharge ports during the wiping operation may be pushed into different color discharge ports by the wipers. Due to such factors, when the next recording is started, initial ink may be color-changed (color-mixed), thereby deteriorating the image.

An operation for in advance ejecting (discharging) the color-mixed ink immediately before the recording in order to prevent the color mixing is referred to as pre-ejection. In the illustrated embodiment, as shown in FIG. 10, a pre-ejection port (pre-ejection receiver) M5045 for receiving the ink discharged by the pre-ejection is disposed in the vicinity of the cap M5001, and, after the recording element substrate H1100 of the recording head H1001 is shifted to be opposed to the pre-ejection port M5045 immediately before the recording, the pre-ejection is carried out. Incidentally, the pre-ejection port M5045 is defined by a pre-ejection absorbing body M5046 and a pre-ejection cover M5047, and the pre-ejection absorbing body M5046 is connected to an ink containing portion (waste ink absorbing portion)(not shown).

FIG. 11 is a block diagram showing an entire construction of an electrical circuit of the ink jet recording apparatus according to an embodiment of the present invention. Next, the construction of the electrical circuit of the ink jet recording apparatus according to the illustrated embodiment will be explained with reference to FIG. 11. The electrical circuit of the ink jet recording apparatus according to the illustrated embodiment is mainly constituted by a carriage substrate (CRPCB; CR printed circuit board) E0013, a main substrate (main PCB) E0014, a power source unit E0015, etc. Here, the power source unit E0015 is connected to the main substrate (main PCB) E0014 and serves to supply various driving sources. Further, the carriage substrate E0013 is a print substrate unit mounted to the carriage M4001 (FIG. 8) and acts as an interface for sending/receiving a signal with respect to the recording head H1001 via a contact FPC E0011. Further, this substrate serves to detect change in positional relationship between the encoder scale E0005 and the encoder sensor E0004 on the basis of a pulse signal outputted from the encoder sensor E0004 as the carriage M4001 is shifted, and to output an output signal (detection signal) to the main substrate E0014 through the carriage flexible flat cable (CRFFC) E0012.

Further, the main substrate (main PCB) E0014 is a print substrate unit for controlling the driving of various parts of the ink jet recording apparatus according to the illustrated embodiment, and, on this substrate, there are provided I/O ports corresponding to a sheet end detection sensor (PE sensor) E0007, an auto sheet feed sensor (ASF sensor) E0009, a cover sensor E0022, a parallel interface (parallel I/F) E0016, a serial interface (serial I/F) E0017, a resume key E0019, an LED (light emitting element) E0020, a power source key E0018 and a buzzer E0021. Further, the main substrate (main PCB) E0014 is connected to the carriage motor E0001, LF motor E0002 and purge motor E0003 to control the driving of such motors, and has connection interfaces for connection to the sheet-to-sheet sensor (GAP sensor) E0008, purge sensor E0010, carriage flexible flat cable (CRFFC) E0012 and power source unit E0015.

Figure 12:
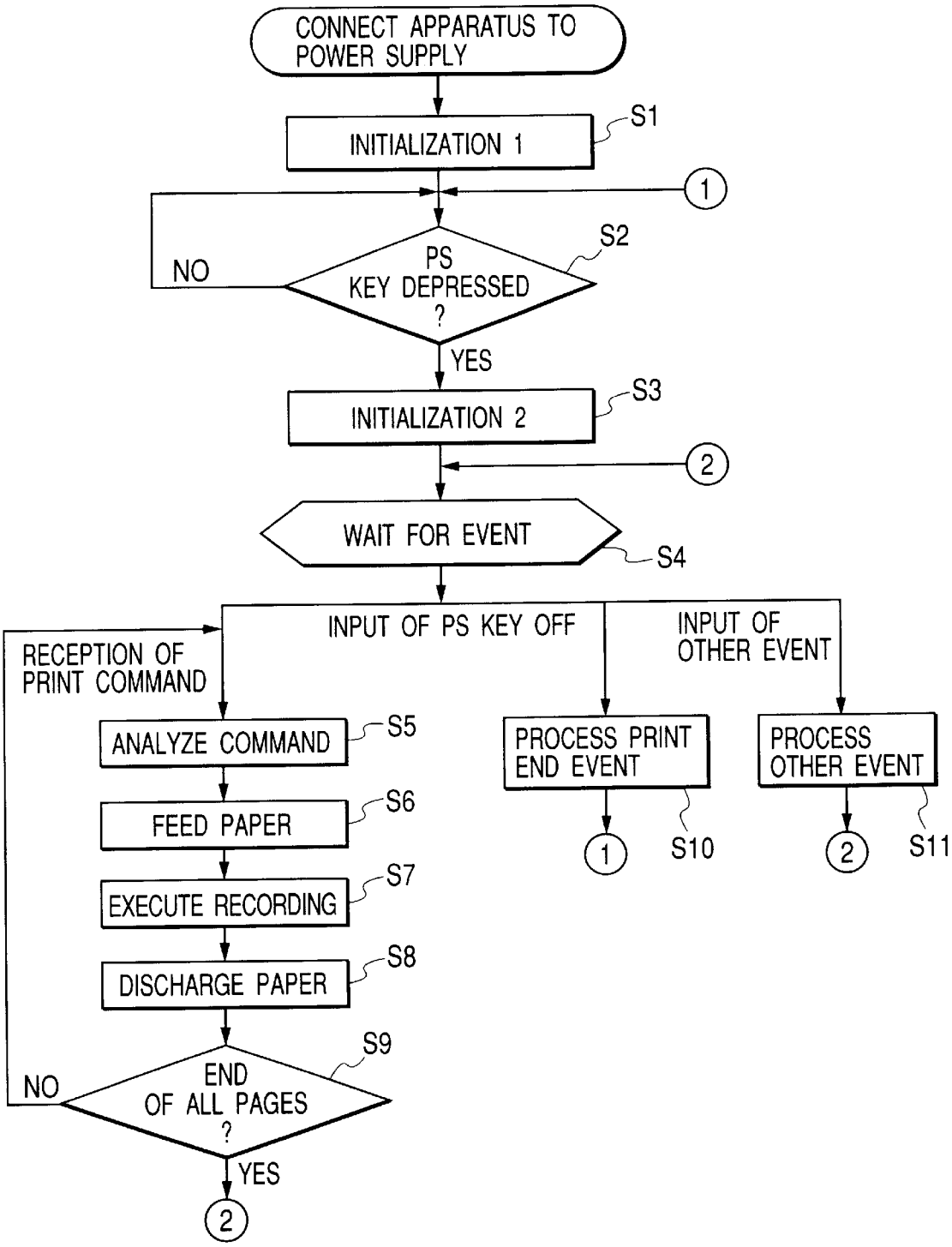
FIG. 12 is a flow chart showing a recording operation sequence of the ink jet recording apparatus according to the embodiment.

FIG. 12 is a flow chart showing the operation of the ink jet recording apparatus according to the embodiment of the present invention. Next, the operation of the ink jet recording apparatus as constructed above will be explained with reference to FIG. 12. In FIG. 12, when the ink jet recording apparatus is connected to an AC power source, first of all, a first initialization process of the apparatus is executed in a step S1. In this initialization process, an electric circuit system such as a ROM and a RAM of the apparatus is checked to ascertain that the apparatus can correctly be operated electrically. Then, in a step S2, it is judged whether the power source key E0018 provided on the upper case M1002 of the main body M1000 is turned ON or not. If the power source key E0018 is turned ON, the program goes to a next step S3, where a second initialization process is executed. In this second initialization process, various driving mechanisms and head system of the apparatus are checked. That is to say, it is ascertained whether the apparatus is operated correctly when the various motors are initialized and the head information is read in.

Then, in a step S4, waiting for event is effected. That is to say, command event from an external I/F, panel key event effected by user's manipulation, internal control event, etc. are monitored with respect to the apparatus, and, when such event is generated, a process corresponding to such event is executed. For example, in the step S4, if recording (print) command event is received from the external I/F, the program goes to a step S5. In the step S5, if power source key event effected by the user's manipulation is generated, the program goes to a step S10. In the step S10, if other event is generated, the program goes to a step S11. Here, in the step S5, a record command from the external I/F is analyzed to judge designated paper type, paper size, recording quality and paper feed method, data representing a judged result is stored in a RAM E2005 of the apparatus, and then, the program goes to a step S6. Then, in the step S6, the paper feeding is started by the paper feeding method designated in the step S5 to send the paper to the recording start position, and then, the program goes to a step S7.

In the step S7, the recording operation is performed. In the recording operation, recording data sent from the external I/F is temporarily stored in a print buffer, and then, the carriage motor E0001 is driven to start the shifting of the carriage M4001 in the scanning direction and to supply the recording data stored in the print buffer to the recording head H1001, thereby effecting one-line recording. When the one-line recording of the recording data is finished, the LF motor E0002 is driven to rotate the LF roller M3001, thereby conveying the paper as the recording medium in the sub-scanning direction. Thereafter, the above operations are executed repeatedly. When one page recording of the recording data is finished, the program goes to a step S8. In the step S8, the LF motor E0002 is driven to drive the paper discharge roller M2003, thereby effecting the paper feeding until it is judged that the paper is fed out from the apparatus completely. When the paper feeding is finished, the paper is discharged onto the paper discharge tray M1004*a* completely.

Then, in a step S9, it is judged whether the recording operation for all pages to be recorded is finished or not. If there is any page(s) to be recorded, the program is returned to the step S5, from which the operations in the steps S5 to S9 are repeated. At a time when the recording operation for all pages to be recorded is finished, the recording operation is completed, and, thereafter, the program is returned to the step S4, where next event is waited. On the other hand, in a step S10, a process for ending a printer is executed to stop the present apparatus. That is to say, after the power source is shifted to a turn-off allowable condition to disenable the power of the motors, the head, etc., the power source is turned OFF and the program is returned to the step S4 to wait for next event. Further, in the step S11, a process for other event than the above is executed. For example, a process corresponding to a recovery process command of the recording head from the various panel keys or the external I/F or internally generated recovery event is executed. Incidentally, after the process is finished, the program is returned to the step S4, where next event is waited.

Figure 23:
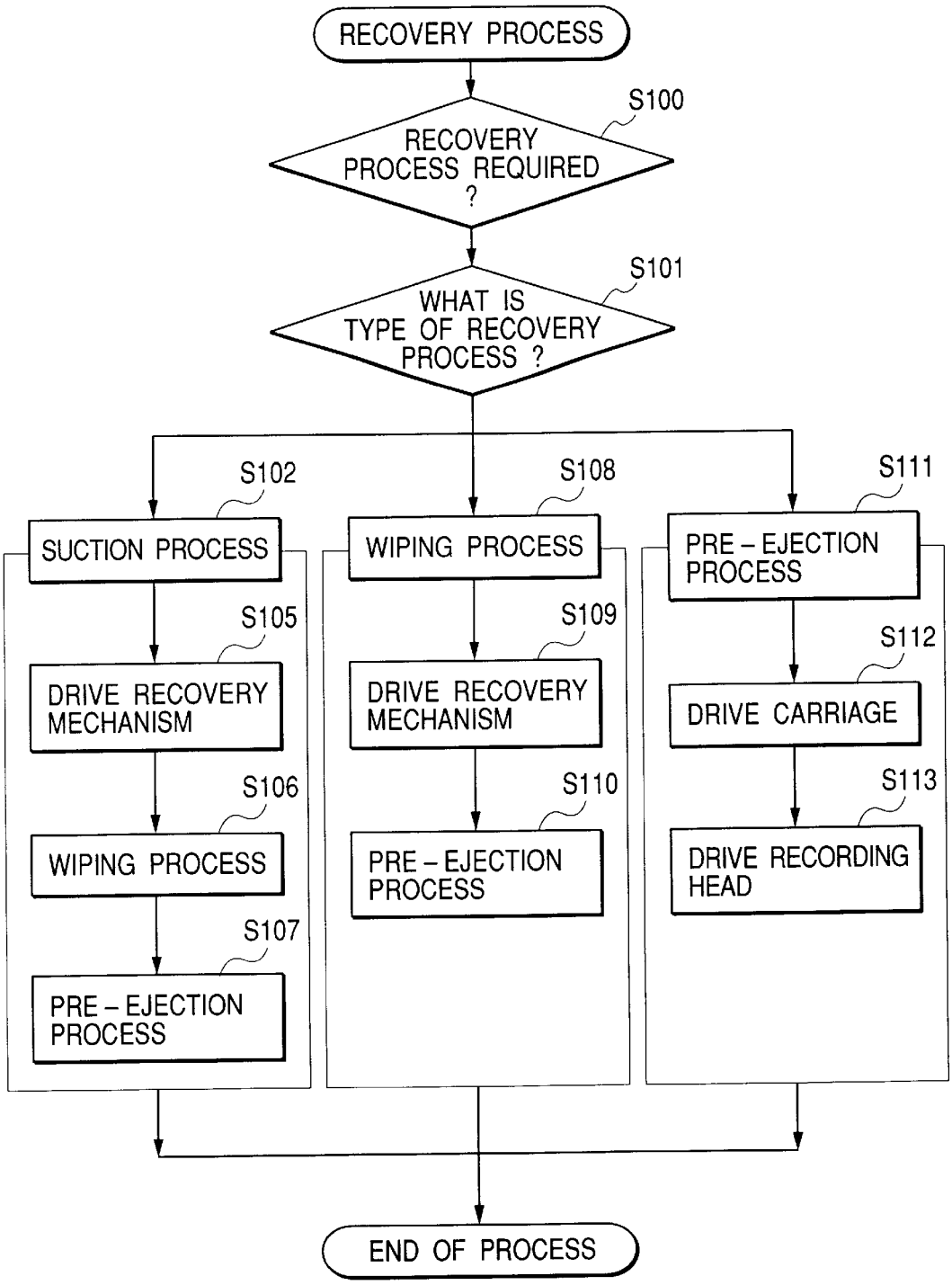
FIG. 23 is a flow chart showing an operation sequence of recovery processing of the ink jet recording apparatus according to the embodiment.

FIG. 23 is a flow chart showing operation sequence of the recovery process effected by the recovery unit M5000 of the ink jet recording apparatus to which the present invention is applied. Here, while the ink discharging according to the illustrated embodiment will be explained, the ink discharging is effected in accordance with the recovery process of the recording head H1001. The recovery process of the recording head H1001 is executed, for example, under a circumstance generated when the recording head H1001 is mounted to the recording apparatus, when the ink tank H1900 is mounted or exchanged, when a predetermined time period is elapsed after the recording head H1001 and the ink tanks H1900 are mounted, when predetermined amount recording is carried out or when the operator judges that trouble such as deterioration of image quality of the recorded result occurs.

In FIG. 23, in a step S100, if the CPU E1001 judges that there is such a circumstance, the program goes to a next step S101, where a mode of the recovery process to be executed in accordance with that circumstance is analyzed. In the illustrated embodiment, the recovery process generically includes suction process, wiping process and pre-ejection process. The suction process is a process operation in which the ink is sucked and discharged from the discharge ports of the recording head by generating the negative pressure within the cap by driving the pump M5100 of the recovery unit M5000 in a condition that the discharge ports H1100T (or 1182) of the recording head H1001 is closely sealed by the cap M5001. Further, the wiping process is a process operation in which the wiper blades M5011, M5012*a*, M5012*b* of the recovery unit M5000 are driven to wipe and clean the surface of the discharge port face 1181 (or recording element substrate H1100) of the recording head H1001. Further, the pre-ejection process is a process operation in which the inks in the discharge ports are refreshed by discharging the inks from the discharge ports of the recording head H1001, thereby restoring and maintaining the ink discharging performance of the recording head in the condition suitable for the recording.

In FIG. 23, in the step S101, if the type of the desired recovery process operation is suction process, the program goes to a step S102. The suction process is executed, for example, when the recording head H1001 is mounted to the recording apparatus or when the ink tank H1900 is mounted or exchanged or when the operator judges that the trouble of the recorded result occurs. In the step S102, when the suction process is commanded, first of all, the carriage M4001 is driven and scanned up to the position where the cap M5001 of the recovery unit M5000 is opposed to the recording head H1001. Thereafter, the cap M5001 of the recovery unit M5000 is urged against the discharge port face 1181 (recording element substrate M1100) of the recording head H1001 to create the capping condition, and then the pump M5100 is driven (step S105).

By this operation, the ink is sucked from the recording head H1001 via the cap M5001, and the sucked ink is directed from the suction port of the cap to the pump tube M5019 and is discharged into the waste ink absorbing body (not shown) as the ink containing portion provided in the lower case M1001. When the suction operation is finished, the program goes to a step S106, where the wiping process is executed. The wiping process is a process operation in which the ink adhered to the discharge port face 1181 (recording element substrate M1100) during the suction process is cleaned and removed by driving the wiper blades M5011, M5012*a*, M5012*b*. After the wiping process, the program goes to a step S107, where the pre-ejection process is executed. The pre-ejection process is a process operation in which the carriage M4001 is driven and scanned up to a position where the discharge port face 1181 of the recording head H1001 is opposed to a pre-ejection port M5045 provided in the recovery unit M5000, and, in this condition, the inks in the discharge ports 1182 are refreshed by preliminarily discharging the inks by driving the recording head H1001. The ink discharged by the pre-ejection process is directed to and collected in an ink containing portion (for example, waste ink absorbing body M5200 shown in FIG. 9) arranged at a predetermined position through the pre-ejection port M5045.

Further, in the step S101, if the desired recovery process is the wiping process, the program goes to a step S108, where only the wiping process is executed; whereas, if the desired recovery process is the pre-ejection process, the program goes to a step S111. In the illustrated embodiment, a condition that only the wiping process is desired or requested is, for example, a case where the ink greater than a predetermined amount is discharged during the recording. Further, a condition that only the pre-ejection is desired or requested is, for example, a case where a time period during which the ink is not discharged is elapsed for a predetermined time or more. Incidentally, the driving of the recovery unit M5000 (step S109) and the pre-ejection process (step S110) effected during the wiping process in the step S108, and, the driving of the carriage M4001 (step S112) and ink discharging caused by driving the recording head (step S113) effected during the pre-ejection process in the step S111 are carried out substantially in the same manner as the aforementioned corresponding operations.

Figure 13:
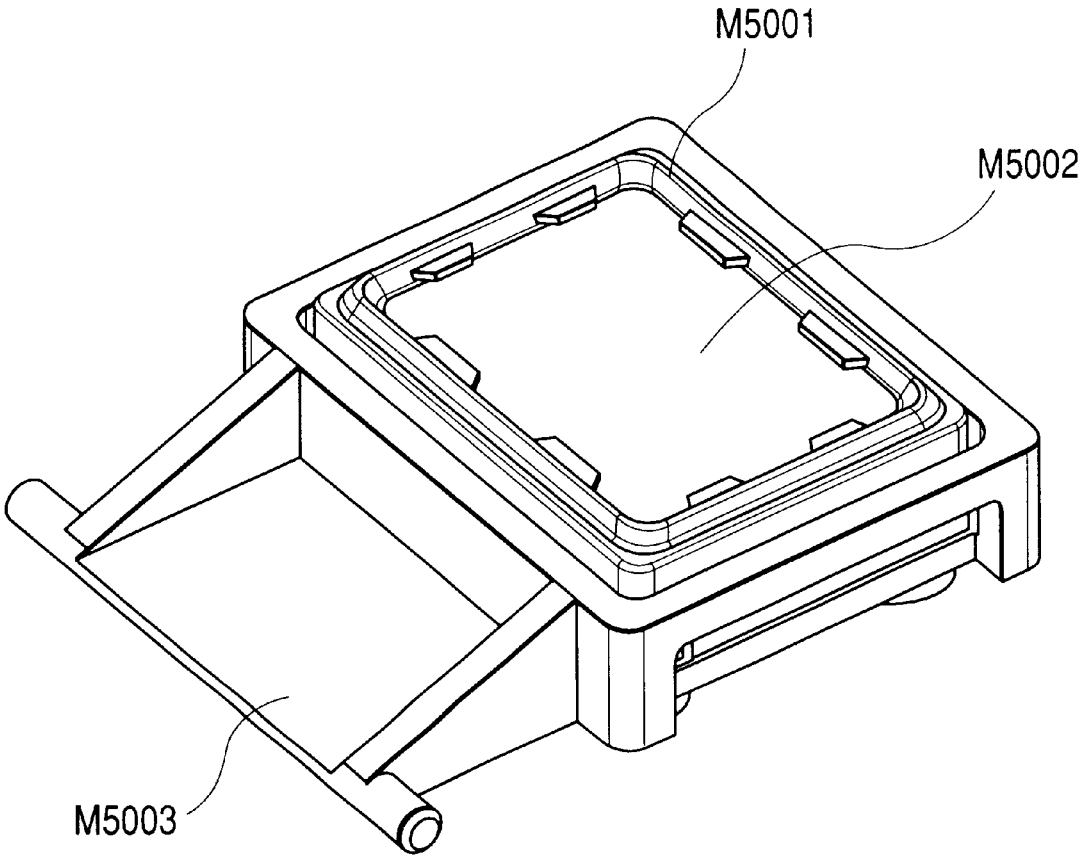
FIG. 13 is a schematic perspective view showing a structure of a cap unit according to a first embodiment used in the recovery unit of the ink jet recording apparatus to which the present invention.
Figure 14:
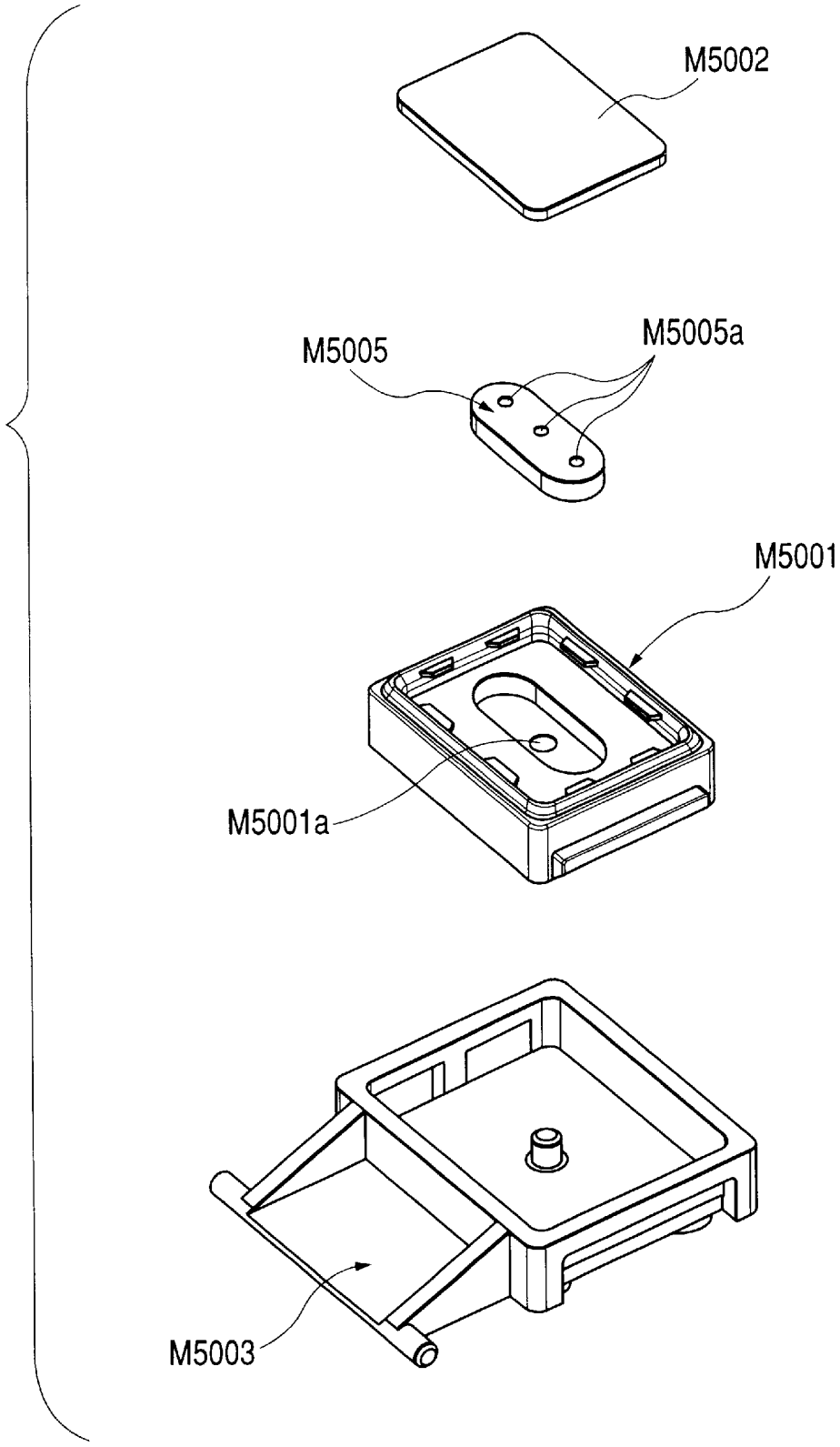
FIG. 14 is an exploded perspective view of the cap unit, looked at from the above.
Figure 15:
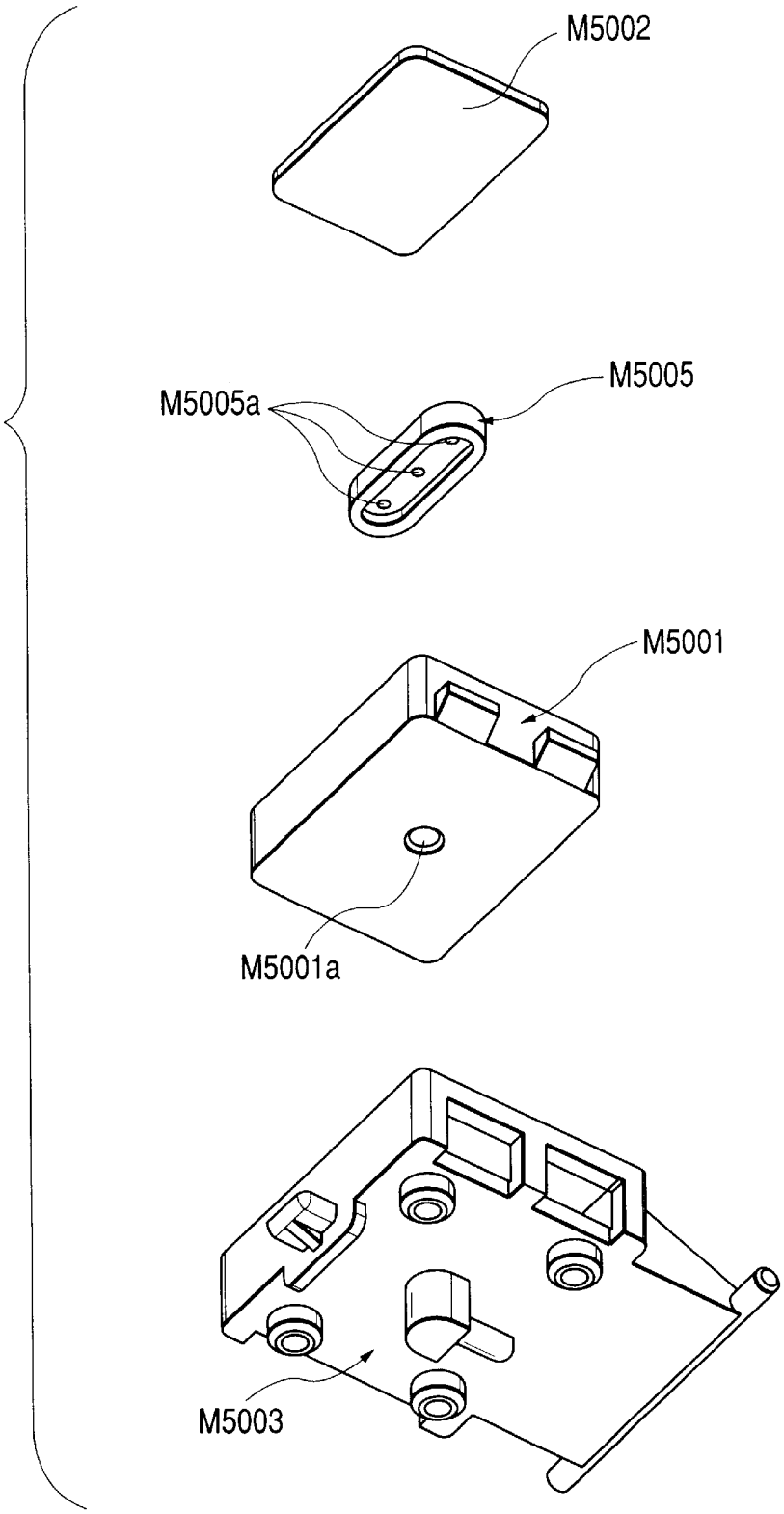
FIG. 15 is an exploded perspective view of the cap unit, looked at from the below.
Figure 16:
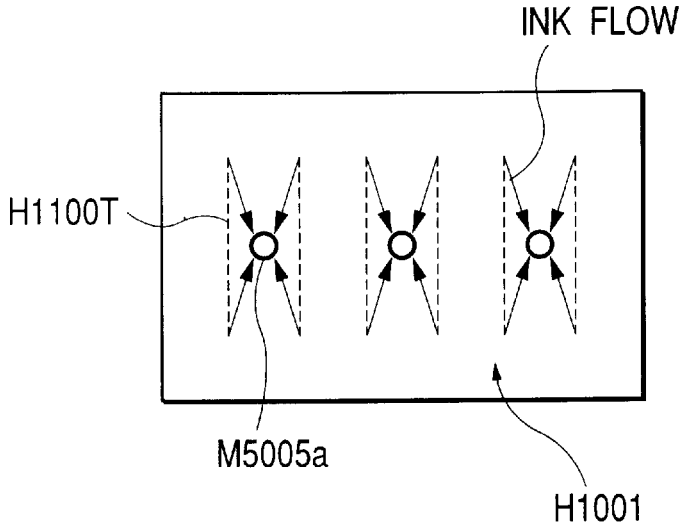
FIG. 16 is a schematic explanatory view showing a positional relationship between discharge port arrays and suction holes of the cap when the recording head is capped by the cap unit of FIG. 13.

Next, various embodiments of a cap unit of a recovery unit M5000 having most characteristic constructions in the ink jet recording apparatus to which the present invention is applied and in the suction method fo the apparatus will be explained. FIGS. 13 to 16 show main parts of the recovery portion in a first embodiment of the ink jet recording head to which the present invention is applied, and the recovery portion (recovery unit) M5000 according to the illustrated embodiment is designed to include a cap M5001. FIG. 13 is a perspective view showing a condition that the cap M5001, cap absorbing body M5002 and flow path forming member M5005 are incorporated into a cap holder M5003. FIG. 14 is an exploded perspective view of FIG. 13, and FIG. 15 is an exploded perspective view showing an exploded condition of FIG. 14, looked at from another direction. FIG. 16 is a view showing a relative positional relationship between the discharge ports H1100T (discharge ports 1182—see FIG. 24) and suction ports M5005*a* of the flow path forming member M5005 of the cap M5001 when the cap M5001 abuts against the recording element substrate H1100 (discharge port face 1181), and ink flows until the inks flown from the discharge ports H1100T reach the suction ports M5005*a* during the suction recovery process operation.

As shown in FIG. 14, during the suction recovery operation of the recovery unit (recovery portion) M5000 of the present invention, when the negative pressure condition is established within the cap M5001 due to the negative pressure generated by the pump M5100, the ink is flown from the discharge ports H1100T of the recording element substrate H1100 of the recording head H1001 and then is discharged from the suction port M5001*a* of the cap through the plurality (three in the illustrated example) of suction ports M5005*a* provided in the flow path forming member M5005 constituting a part of the cap through the cap absorbing body M5002. As shown in FIG. 16, each of the three suction ports M5005*a* provided in the flow path forming member M5005 of the cap M5001 is disposed at a center between a pair of discharge port arrays among a plurality of discharge port arrays each including plural discharge ports H1100T, and the inks flown out from the discharge ports H1100T of each discharge port array reach the corresponding suction port M5005*a* through paths shown by the arrows.

By such an action, the amount of ink flown out from other discharge port array and passing by each discharge port is decreased. Consequently, amounts of different color inks stayed in the vicinity of each discharge port H1100T immediately after the suction operation are decreased, with the result that a rate of different color ink flowing into the discharge port H1100T due to the ink back flow generated when the negative pressure in the recording head H1001 (caused by the suction operation) is released, is decreased. Thus, while the amount of inks discharged from the discharge ports H1001T in the pre-ejection operation executed after the subsequent wiping operation is reduced, the problem regarding the color mixing (in which different color inks are mixed) due to the back flow of the inks into the discharge ports can be eliminated.

Figure 17:
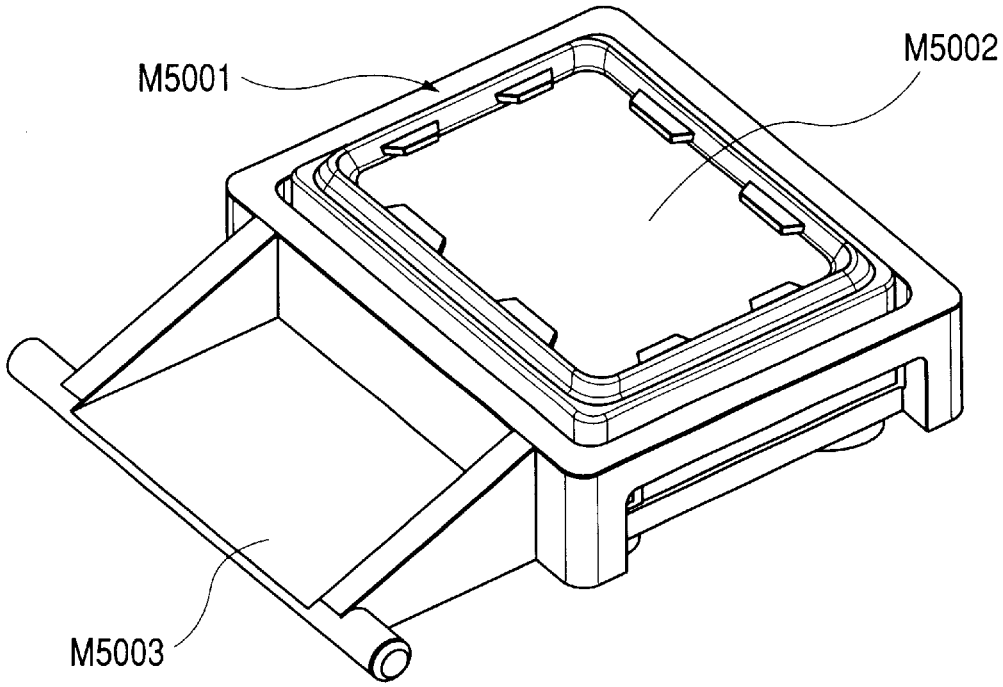
FIG. 17 is a schematic perspective view of a cap unit according to a second embodiment used in the recovery unit of the ink jet recording apparatus to which the present invention is applied.
Figure 18:
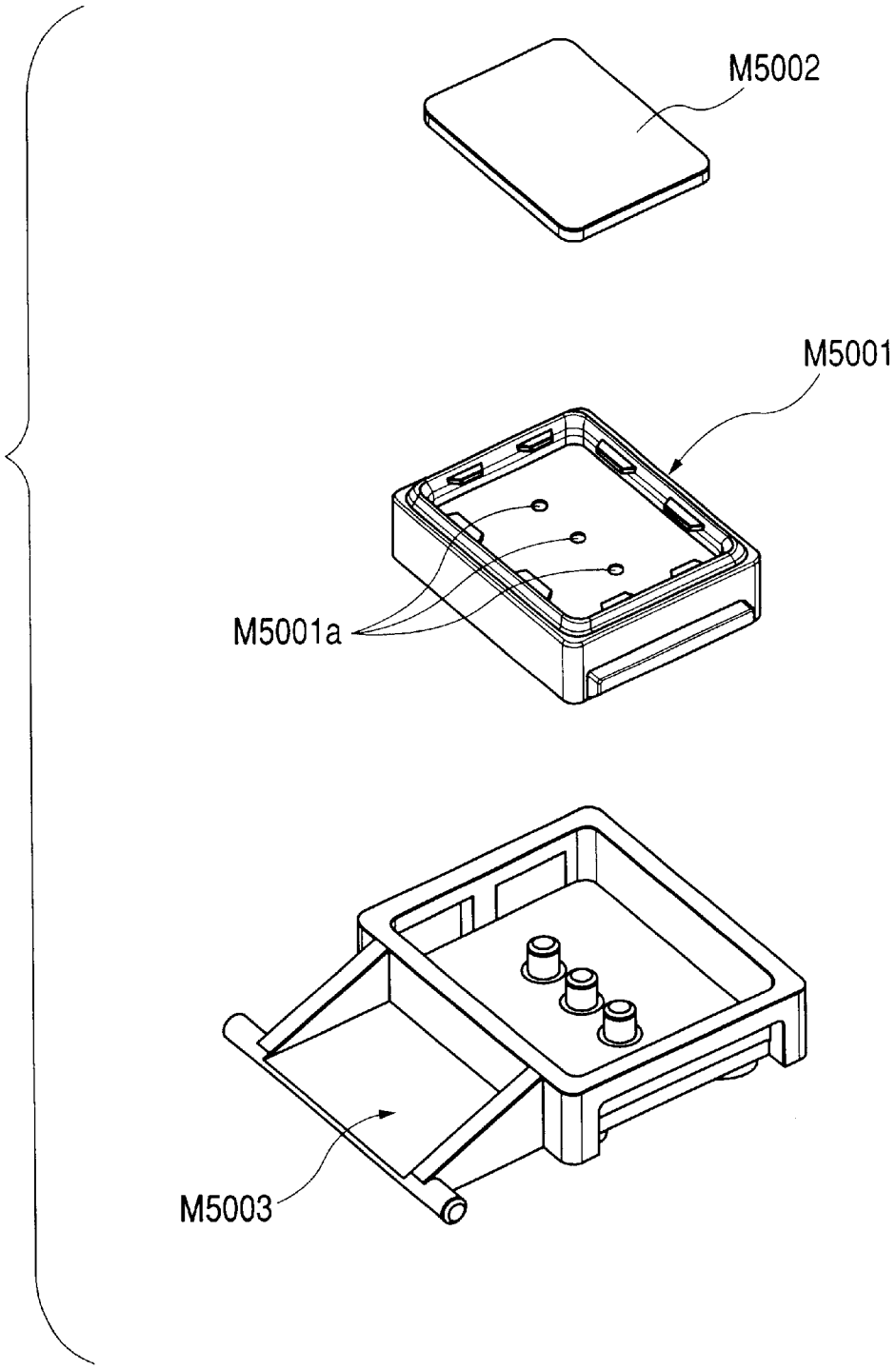
FIG. 18 is an exploded perspective view of the cap unit of FIG. 17, looked at from the above.
Figure 19:
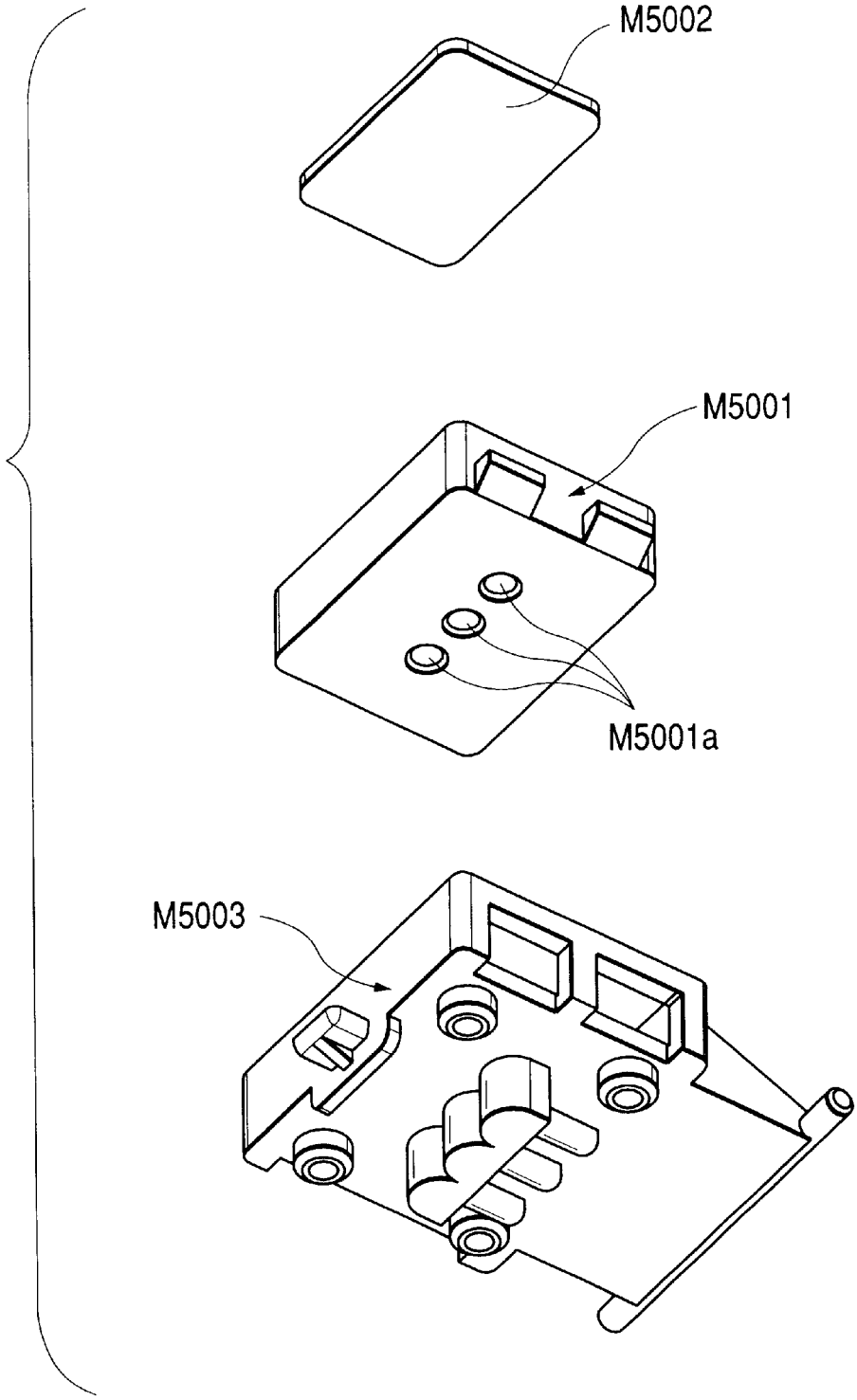
FIG. 19 is an exploded perspective view of the cap unit of FIG. 17, looked at from the below.

FIGS. 17 to 19 show main parts of a recovery portion according to a second embodiment of an ink jet recording apparatus to which the present invention is applied, and the recovery portion (recovery unit) M5000 according to this embodiment also includes a cap M5001. FIG. 17 is a perspective view showing a condition that the cap M5001, cap absorbing body M5002 and flow path forming member M5005 are incorporated into the cap holder M5003, FIG. 18 is an exploded perspective view of FIG. 17, and FIG. 19 is an exploded perspective view showing the exploded condition of FIG. 18, looked at from a different direction. As shown in FIGS. 17 to 19, by providing a plurality (three in the illustrated example) of suction ports M5001*a* in the cap M5001, the same effects as the first embodiment can be achieved. Further, the discharged inks may be joined in a path extending from the cap holder M5003 to the pump M5100 or the cap suction ports may be connected to respective pumps M5100.

Figure 20A:
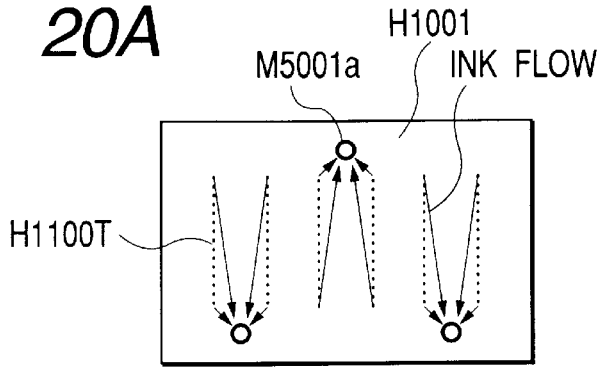
FIGS. 20A, 20B, 20C and 20D are views showing examples of a positional relationship between discharge port arrays and suction holes of the cap in a cap unit according to a third embodiment used in the recovery unit of the ink jet recording apparatus to which the present invention is applied.
Figure 20B:
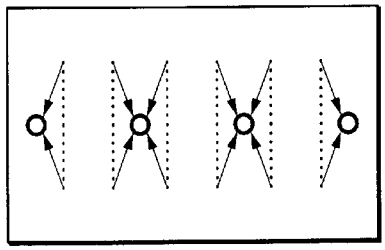
Figure 20C:
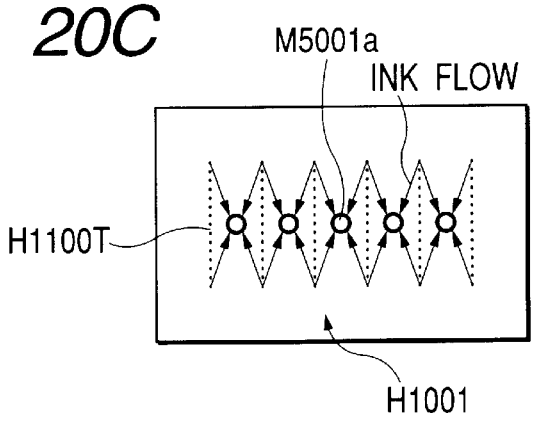
Figure 20D:
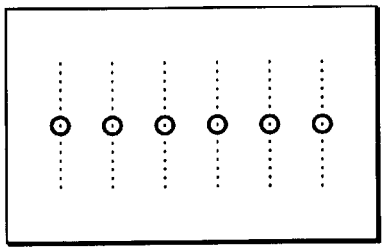

FIGS. 20A to 20D are views showing several examples of a positional relationships between the discharge port arrays of the recording head and the cap suction ports in a third embodiment of a cap unit used in the recovery unit of the ink jet recording apparatus to which the present invention is applied. As shown in FIGS. 20A to 20D, even when relative positional relationships between the plural cap suction ports M5001*a* and the plural discharge port arrays are selected as shown in FIGS. 20A to 20D, respectively, the same or more effects as the first and second embodiments can be achieved. FIG. 20A shows an arrangement in which each suction port is positioned at ends of the discharge port arrays so that ink flows from the discharge ports to the cap suction ports M5001*a* are prevented from being crossed. This is one example of the positional relationship between the discharge port arrays of the recording head and the cap suction ports when the arrangement of the cap suction ports M5001*a* is restricted or limited by the construction of the apparatus. If the arrangement is limited in this way, the arrangement may be selected in accordance with the limitation. FIGS. 20B, 20C and 20D show examples of the positional relationship between the discharge port arrays and the cap suction ports, in which the number of cap suction ports M5001*a* is increased (greater in order of FIG. 20B to FIG. 20D) as comparison with the first and second embodiment of the present invention, so that the concentration of inks flown from the discharge port arrays is avoided and paths between the discharge ports and the cap suction port M5001*a* are shortened, thereby enhancing efficiency. FIG. 20B shows an arrangement in which the number of cap suction ports M5001*a* is increased by one as comparison with the positional relationship between the discharge port arrays of the recording head and the cap suction ports in the first embodiment. Although this arrangement becomes more complicated, respective ink flows are more spaced apart from each other, thereby achieving more excellent effect. FIG. 20C shows an arrangement in which the cap suction ports M5001*a* are disposed between adjacent discharge port arrays regarding all of the discharge port arrays. This is more effective in the point that the inks from the discharge port arrays are not mixed. FIG. 20D shows an arrangement in which the cap suction port M5001*a* is disposed at a middle position of each discharge port array. This is more effective in the point that the inks from the discharge port arrays are not mixed.

Figure 21A:
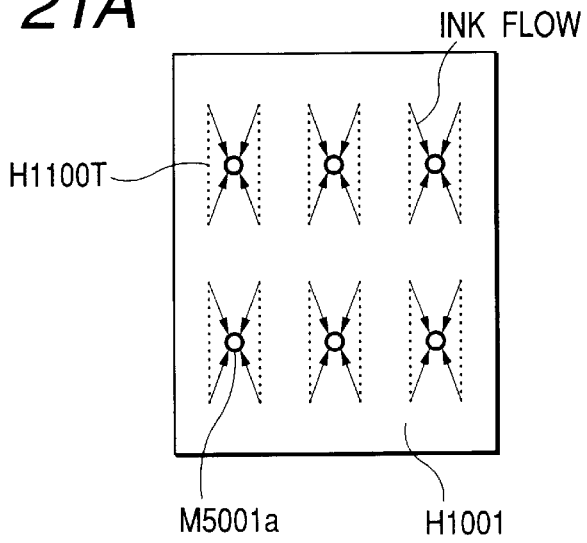
FIGS. 21A, 21B and 21C are views showing examples of a positional relationship between discharge port arrays and suction holes of the cap in a cap unit according to a fourth embodiment used in the recovery unit of the ink jet recording apparatus to which the present invention is applied.
Figure 21B:
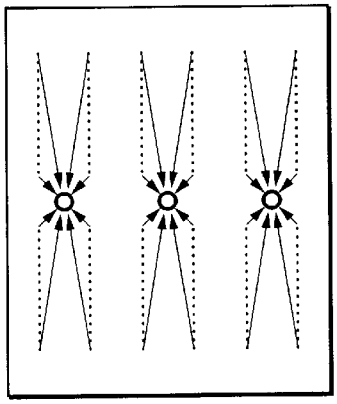
Figure 21C:
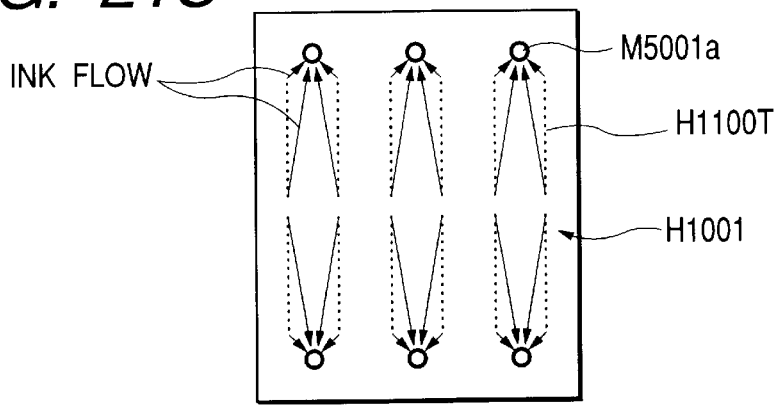
Figure 22:
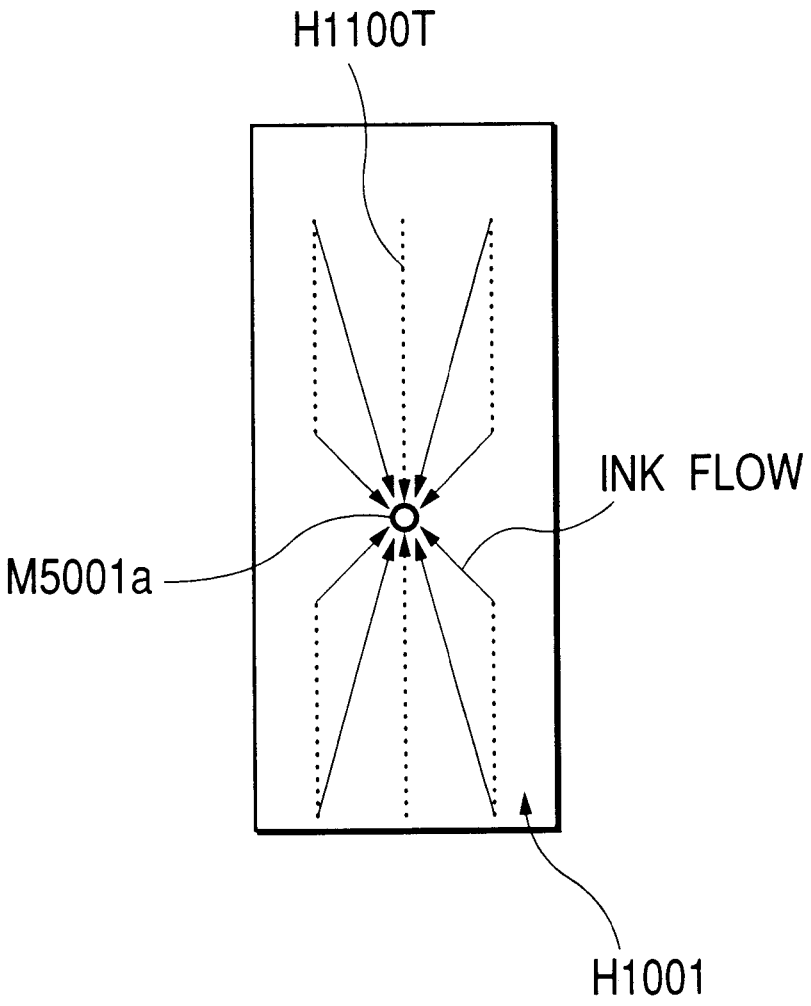
FIG. 22 is a view showing an alteration of the positional relationship between discharge port arrays and suction holes of the cap in the fourth embodiment shown in FIGS. 21A to 21C.

FIGS. 21A to 21C are views showing several examples of a positional relationships between the discharge port arrays of the recording head and the cap suction ports in a fourth embodiment of a cap unit used in the recovery unit of the ink jet recording apparatus to which the present invention is applied, and FIG. 22 is a view showing an alteration of the positional relationship between the discharge port arrays and the cap suction port in the fourth embodiments shown in FIGS. 21A to 21C.

Here, not only when the discharge port arrays are in parallel, but also even when the discharge port arrays are in serial, by arranging them as shown in FIGS. 21A, 21B and 21C, the same effects as the aforementioned embodiments can be achieved.

Further, as shown in FIG. 22, by arranging a single cap suction port M5001*a* at a center of six (in total) discharge port arrays comprised of two rows (two discharge port arrays in serial) and three columns three discharge port arrays side by side), six discharge port arrays can be associated with the single suction port.

Incidentally, in the above-mentioned embodiments, the same ink is discharged from the plural discharge ports constituting one discharge port array, and the plural inks are discharged by providing a plurality of discharge port arrays. However, as the case may be, one type ink may be discharged by using one discharge port and plural different inks may be discharged from plural discharge ports. The present invention can similarly be applied to an ink jet recording apparatus having such recording means, thereby achieving the same effects. Such an ink jet recording apparatus is also included within the scope of the invention.

According to the above-mentioned embodiments, in the ink jet recording apparatus in which the recording is effected by using the recording means (recording head H1001) for discharging the plural different inks, there is provided the suction recovery mechanism comprising the cap M5001 for covering the plural discharge ports H1100T (or 1182) for discharging the different inks, and the pump M5100 connected to the suction port M5001*a* of the cap (or suction ports M5005*a* of the flow path forming member M5005 constituting the part of the cap) to apply negative pressure in the cap, and, as shown in FIG. 16, FIGS. 20A to 20D, FIGS. 21A to 21C, and FIG. 22, the discharge port and the suction port(s) are arranged in such a manner that flow paths of the ink flowing from each discharge port to the suction port when the ink is sucked from each discharge port by driving the pump does not pass by the discharge ports for different inks.

Further, in the above-mentioned embodiments, the plurality of suction ports M5001*a* or M5005*a* are formed, and a flow path of the ink flowing from each discharge port H1100T of the recording head H1001 to at least one suction port is arranged not to pass by the discharge ports for the different inks. Further, in the above-mentioned embodiments, an arrangement in which the discharge ports for different inks are not disposed on the same line connecting between each discharge port and the suction port, or an arrangement in which a plurality of suction ports are formed in the cap and the discharge ports for the different inks are not disposed on the same line connecting between each discharge port, and at least one suction port is adopted. Further, in the above-mentioned embodiments, the plural different inks may be different color inks or inks having the same color but different densities. Furthermore, in the above-mentioned embodiments, the recording head H1001 as the recording means has a plurality of discharge port arrays for discharging plural different inks, and each discharge port array includes a plurality of discharge ports for discharging the same ink.

According to the above-mentioned embodiments, since the inks sucked from the discharge ports H1100T (or 1182) can be sent out of the cap in such a manner that each ink does not pass by the different ink discharge ports, even when the plural different inks are sucked by using the single cap M5001, the ink can be prevented from entering into the different ink discharge ports. Thus, the recording means can be recovered to the normal or correct image recording condition without any color mixing with simple and cheap construction and with pre-ejection operation having low consumption of ink for a short time. Further, an ink jet recording apparatus in which generation of ink mist due to the pre-ejection can be reduced to prevent contamination of the interior of the apparatus and a suction recovery method for such an apparatus are provided.

Incidentally, in the above-mentioned embodiments, while an example that the ink jet recording apparatus of serial type in which the recording is effected while shifting the recording head as the recording means in the main scanning direction has been explained, the present invention can similarly be applied to an ink jet recording apparatus of line type in which the recording is effected only by the sub-scanning by using an ink jet head of line type having a length to cover a whole width or a part of the width of the recording medium, thereby achieving the same effects. Further, the present invention can similarly be applied regardless of the number of recording heads and regardless of the number of discharge port arrays or discharge ports provided in the single recording head, such as a recording head having a plurality of discharge port arrays or discharge ports in the same discharge port face, and, further, can similarly be applied to a color ink jet recording apparatus in which the recording is effected with plural different colors by using a single recording head or plural recording heads, or a gradation record ink jet recording apparatus in which the recording is effected with the same color but different densities, or an ink jet recording apparatus having a combination thereof, thereby achieving the same effects.

Further, the present invention can similarly be applied to any arrangement having any positional relationship between a recording head and an ink tank, such as an arrangement using an exchangeable ink jet cartridge in which a recording head and an ink tank are formed integrally, or an arrangement using recording means in which an ink tank is detachably mounted to a recording head or an arrangement in which a recording head and an ink tank are separately provided and the recording head and the ink tank are interconnected by an ink supply path, thereby achieving the same effects. Further, in the above-mentioned embodiments, while an example that the recording head in which the liquid ink is discharged from the recording head has been explained, the present invention can similarly be applied to an ink jet recording apparatus in which the recording is effected by liquidizing solid ink and discharging the liquidized ink, and such an ink jet recording apparatus is also included in the scope of the invention.

Further, for example, while the present invention can be applied to an apparatus utilizing electrical/thermal converters such as piezo-electric elements, among them, in an ink jet recording apparatus using a recording head of type in which ink is discharged by utilizing thermal energy, the present invention provides excellent effects. According to such a type, high density recording and highly fine recording can be achieved.

What is claimed is:

1. An ink jet recording apparatus for recording with recording means having at least first and second discharge port arrays, the first and second discharge port arrays for discharging respectively different first and second inks, said ink jet recording apparatus comprising:

one cap for covering both of the first and second discharge port arrays, said cap having at least one suction port; and a pump connected to said suction port of said cap and constructed to apply negative pressure to an interior of said cap, wherein said suction port is arranged so that an ink flow path extends from the first discharge port array to said suction port corresponding to said discharge port array, and wherein the second discharge port array is not disposed on the ink flow path.

2. An ink jet recording apparatus according to claim 1, wherein a plurality of suction ports are formed in said cap, and wherein a respective plurality of flow paths extends from each discharge port array to a corresponding one of said plurality of suction ports, and wherein a discharge port array adapted for discharging a different ink is not disposed on any of said plurality of flow paths.

3. An ink jet recording apparatus according to claim 1, wherein said suction port is arranged so that the second discharge port array is not disposed between the first discharge port array and said suction port.

4. An ink jet recording apparatus according to claim 1, wherein a plurality of said suction ports are formed in said cap, and said plurality of suction ports are arranged so that between each discharge port array and at least one suction port, a discharge port array adapted for discharging a different ink is not disposed.

5. An ink jet recording apparatus according to claim 1, wherein each of said discharge port arrays is composed of plural discharge ports for discharging the same ink.

6. An ink jet recording apparatus according to claim 1, wherein said recording means has a plurality of discharge port arrays for discharging plural different inks, and each discharge port array includes a plurality of discharge ports for discharging the same ink.

7. An ink jet recording apparatus according to claim 1, wherein said recording means includes an electrical/thermal converter for generating thermal energy utilized for discharging the ink.

8. An ink jet recording apparatus according to claim 7, wherein said recording means discharges the ink from said discharge port by utilizing film boiling caused in the ink by the thermal energy generated by said electrical/thermal converter.

* * * * *

UNITED STATES PATENT AND TRADEMARK OFFICE

CERTIFICATE OF CORRECTION

PATENT NO. : 6,712,447 B2
DATED : March 30, 2004
INVENTOR(S) : Saito

It is certified that error appears in the above-identified patent and that said Letters Patent is hereby corrected as shown below:

Title page,
Item [57], ABSTRACT,
Line 6, “to interior” should read -- to the interior --.

Column 4,
Line 22, “invention;” should read -- invention is applicable; --.

Column 5,
Line 8, “of mean-” should read -- if mean- --.

Column 6,
Line 49, “M 3024,” should read -- M3024, --.

Column 7,
Line 13, “M 3026” should read -- M3026 --.
Lines 17, 19 and 26, “an” should read -- a --.

Column 20,
Line 4, “fo” should read -- of --.
Line 42, “port” should read -- ports --.

Signed and Sealed this

Fourteenth Day of December, 2004

JON W. DUDAS
*Director of the United States Patent and Trademark Office*